US012195295B2

(12) United States Patent
Ishifune

(10) Patent No.: US 12,195,295 B2
(45) Date of Patent: Jan. 14, 2025

(54) SHEET PROCESSING APPARATUS AND IMAGE FORMING SYSTEM

(71) Applicant: CANON KABUSHIKI KAISHA, Tokyo (JP)

(72) Inventor: Taro Ishifune, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 20 days.

(21) Appl. No.: 18/122,525

(22) Filed: Mar. 16, 2023

(65) Prior Publication Data

US 2023/0294952 A1 Sep. 21, 2023

(30) Foreign Application Priority Data

Mar. 17, 2022 (JP) ..... 2022-042779

(51) Int. Cl.

| | |
|---|---|
| ***B65H 31/34*** | (2006.01) |
| ***B65H 37/04*** | (2006.01) |
| ***B65H 39/04*** | (2006.01) |
| ***B65H 43/06*** | (2006.01) |

(52) U.S. Cl.

CPC ..... *B65H 43/06* (2013.01); *B65H 31/34* (2013.01); *B65H 37/04* (2013.01); *B65H 39/04* (2013.01); *B65H 2301/1635* (2013.01); *B65H 2511/11* (2013.01); *B65H 2511/12* (2013.01); *B65H 2801/06* (2013.01)

(58) Field of Classification Search

CPC ..... B65H 31/02; B65H 31/34; B65H 37/04; B65H 43/00; B65H 2404/72; B65H 2404/73; B65H 2511/11; B65H 2511/12; B65H 2408/114; B65H 2408/1144; B65H 2301/36; B65H 2301/363; B65H 2301/444; B65H 2801/06; B65H 29/66; B65H 29/669

USPC ..... 270/58.12; 271/285, 286

See application file for complete search history.

(56) References Cited

U.S. PATENT DOCUMENTS

| | | | | |
|---|---|---|---|---|
| 7,419,151 | B2 * | 9/2008 | Kaneko | B65H 31/40 270/58.11 |
| 8,104,758 | B2 | 1/2012 | Tanaka et al. | |
| 8,292,285 | B2 | 10/2012 | Yokoya et al. | |

(Continued)

FOREIGN PATENT DOCUMENTS

| | | | |
|---|---|---|---|
| JP | 2010-208747 | A | 9/2010 |
| JP | 2012-001370 | A | 1/2012 |
| JP | 2021-088462 | A | 6/2021 |

*Primary Examiner* — Leslie A Nicholson, III
(74) *Attorney, Agent, or Firm* — Venable LLP

(57) ABSTRACT

A sheet processing apparatus includes a stacking portion on which sheets targeted for sheet processing are stacked. In the apparatus, a control unit generates, in a buffer section provided in a conveyance path for conveying sheets to the stacking portion, a sheet bundle in which positions of sheets conveyed on the conveyance path are shifted in sequence to an upstream side in a conveyance direction and overlapped. An alignment unit performs alignment processing in the conveyance direction on the sheet bundle stacked on the stacking portion. A processing unit performs sheet processing on the sheet bundle on which the alignment processing has been performed. The control unit controls shift amounts of the positions of the sheets when the sheets are overlapped in the buffer section in sequence, according to sizes of the sheets conveyed on the conveyance path.

12 Claims, 13 Drawing Sheets

(56) References Cited

U.S. PATENT DOCUMENTS

| | | | | |
|---|---|---|---|---|
| 8,308,154 | B2 * | 11/2012 | Miyake | G03G 15/6544 270/58.12 |
| 8,814,157 | B2 * | 8/2014 | Gamo | B65H 39/10 270/58.12 |
| 11,353,817 | B2 * | 6/2022 | Agata | B65H 31/36 |

* cited by examiner

SHEET PROCESSING APPARATUS AND IMAGE FORMING SYSTEM

BACKGROUND OF THE INVENTION

Field of the Invention

The present invention relates to a sheet processing apparatus and an image forming system including an image forming apparatus and the sheet processing apparatus.

Description of the Related Art

A post-processing apparatus (sheet processing apparatus) that performs predetermined post-processing (sheet processing), such as binding processing or sorting processing, on sheets on which images are formed by an image forming apparatus may be optionally coupled to the image forming apparatus. The post-processing apparatus can be configured to perform alignment processing for aligning positions of a plurality of sheets before performing post-processing on the plurality of conveyed sheets.

Japanese Patent Laid-Open No. 2010-208747 describes a technique for adjusting shift amounts of sheets based on types or basis weights of the sheets in a post-processing apparatus that feeds a plurality of sheets in a stack unit in a state of being shifted in a conveyance direction and overlapped and performs alignment processing of the plurality of sheets in the stack unit. This makes it possible to reliably perform the alignment processing in the stack unit.

As described above, by feeding the plurality of sheets in the stack unit (stacking portion) in a state of being shifted in the conveyance direction and overlapped, the alignment processing in the conveyance direction can be more reliably performed on the respective sheets in the stacking portion according to the shift amounts of the sheets. However, when the shift amount of the sheet is increased, although the accuracy of the alignment processing in the stacking portion can be improved, the total length of a sheet bundle in the conveyance direction lengthens and time required for the alignment processing lengthens. This leads to a decrease in productivity of the post-processing apparatus. On the other hand, when the shift amounts of the sheets are uniformly reduced, the time required for the alignment processing shortens, which leads to improvement in productivity of the post-processing apparatus, but the accuracy of the alignment processing may be reduced.

SUMMARY OF THE INVENTION

Accordingly, an aspect of the present invention provides a technique that allows controlling a shift amount of a sheet in a conveyance direction when a sheet bundle is generated by overlapping a plurality of sheets to be conveyed to a stacking portion such that productivity of a sheet processing apparatus is improved while accuracy of alignment processing of the sheet is maintained.

According to one aspect of the present invention, there is provided a sheet processing apparatus, comprising: a stacking portion on which sheets targeted for sheet processing are stacked; a control unit configured to generate, in a buffer section provided in a conveyance path for conveying sheets to the stacking portion, a sheet bundle in which positions of sheets conveyed on the conveyance path are shifted in sequence to an upstream side in a conveyance direction and overlapped, and to control conveyance of the sheets on the conveyance path such that the sheet bundle is conveyed from the buffer section to the stacking portion; an alignment unit configured to perform alignment processing that aligns positions of the sheets in the conveyance direction, on the sheet bundle stacked on the stacking portion; and a processing unit configured to perform sheet processing on the sheet bundle on which the alignment processing has been performed, wherein the control unit is configured to control shift amounts of the positions of the sheets when the sheets are overlapped in the buffer section in sequence, according to sizes of the sheets conveyed on the conveyance path.

According to another aspect of the present invention, there is provided an image forming system, comprising: an image forming apparatus configured to form an image on a sheet; and a sheet processing apparatus coupled to a downstream side of the image forming apparatus in a conveyance direction of a sheet, and configured to perform sheet processing on the sheet conveyed from the image forming apparatus through a conveyance path, wherein the sheet processing apparatus comprises: a stacking portion on which sheets targeted for the sheet processing are stacked; a control unit configured to generate, in a buffer section provided in the conveyance path for conveying sheets to the stacking portion, a sheet bundle in which positions of sheets conveyed on the conveyance path are shifted in sequence to an upstream side in the conveyance direction and overlapped, and to control conveyance of the sheets on the conveyance path such that the sheet bundle is conveyed from the buffer section to the stacking portion; an alignment unit configured to perform alignment processing that aligns positions of the sheets in the conveyance direction, on the sheet bundle stacked on the stacking portion; and a processing unit configured to perform sheet processing on the sheet bundle on which the alignment processing has been performed, wherein the control unit is configured to control shift amounts of the positions of the sheets when the sheets are overlapped in the buffer section in sequence, according to sizes of the sheets conveyed on the conveyance path.

Further features of the present invention will become apparent from the following description of exemplary embodiments (with reference to the attached drawings).

DESCRIPTION OF THE EMBODIMENTS

Figure 1:
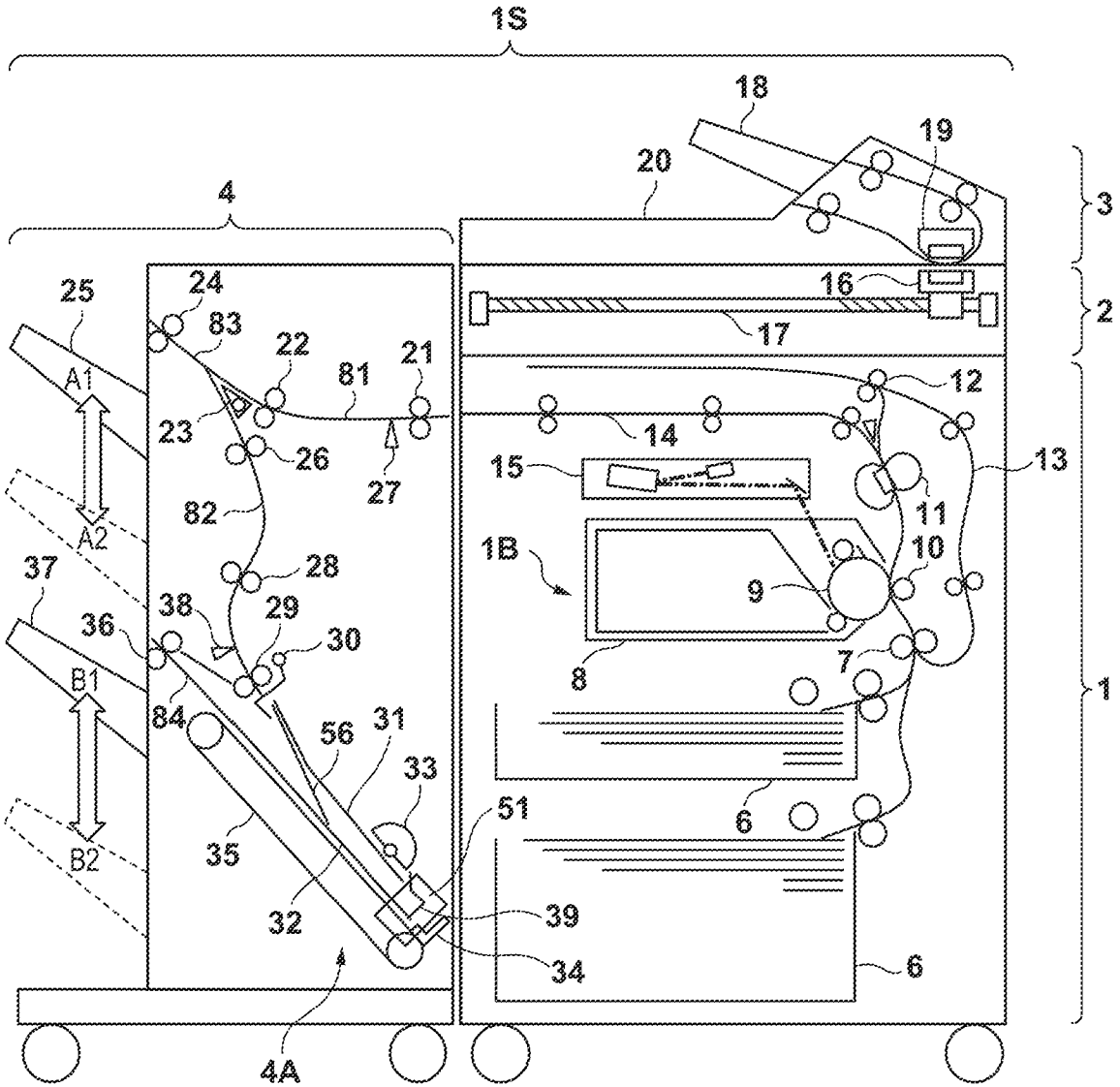
FIG. 1 is a cross-sectional view illustrating a configuration example of an image forming system.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

First Embodiment

<Image Forming System>

FIG. 1 is a cross-sectional view illustrating a configuration example of an electrophotographic image forming system according to an embodiment of the present disclosure. An image forming system 1S of the present embodiment includes an image forming apparatus 1 that forms an image on a sheet and a post-processing apparatus 4 coupled to a downstream side of the image forming apparatus 1 in a conveyance direction of a sheet. The image forming system 1S further includes an image reading apparatus 2 and a document feeding apparatus 3 connected to the image forming apparatus 1. The image forming system 1S forms an image on a sheet as a recording material, and performs post-processing (sheet processing) on the sheet by the post-processing apparatus 4 as necessary. The post-processing apparatus 4 is an example of a sheet processing apparatus that performs predetermined sheet processing on a sheet. In the following, configurations and operations of the respective apparatuses will be described.

The document feeding apparatus 3 conveys a document placed on a document tray 18 to image reading units 16 and 19 of the image reading apparatus 2. The image reading units 16 and 19 are image sensors that read images of documents. The image reading unit 16 is configured to read an image on a first surface of a document, and the image reading unit 19 is configured to read an image on a second surface, which is the back surface of the first surface, of the document. Both surfaces of the document can be read by conveying the document once using the image reading units 16 and 19. The document whose images have been read by the image reading units 16 and 19 is discharged to a document discharge unit 20. Further, the image reading apparatus 2 can read an image from a still document (including a document, such as a booklet document, that cannot be used by the document feeding apparatus 3) set on a platen glass by reciprocating the image reading unit 16 by a driving device 17.

The image forming apparatus 1 includes an image forming unit 1B of a direct transfer method and forms images by an electrophotographic method. A controller (a printer control unit 100 in FIG. 5) of the image forming apparatus 1 controls an image forming operation of the image forming unit 1B based on image data obtained by reading by the image reading units 16 and 19 or image data received from an external device via a network.

The image forming unit 1B includes a cartridge 8 including a photosensitive drum 9 and a laser scanner unit 15 arranged above the cartridge 8. When an image forming operation is performed, the image forming unit 1B charges the surface of the photosensitive drum while rotating the photosensitive drum 9. The laser scanner unit 15 exposes the photosensitive drum 9 based on the image data to form an electrostatic latent image on the drum surface of the photosensitive drum 9. The image forming unit 1B develops an electrostatic latent image carried on the photosensitive drum 9 into a toner image with charged toner particles. The toner image formed on the photosensitive drum 9 is conveyed to a transfer unit where the photosensitive drum 9 is opposed to transfer rollers 10, in accordance with the rotation of the photosensitive drum 9.

The image forming apparatus 1 includes a plurality of sheet feeding units 6, and each of the sheet feeding units feeds sheets one by one to a conveyance path. The sheet fed from the sheet feeding unit 6 is conveyed on the conveyance path, and reaches the transfer unit after skew correction is performed by registration rollers 7. In the transfer unit, the toner image carried on the photosensitive drum 9 is transferred on the sheet by the transfer rollers 10. A fixing unit 11 is arranged downstream of the transfer unit in the sheet conveyance direction. The fixing unit 11 includes a rotation body pair that nip and convey the conveyed sheet, and a heating element, such as a halogen lamp, for heating the toner image on the sheet, and performs fixing processing of the image by heating and applying pressure on the toner image on the sheet.

When the sheet on which the image is formed in this way is discharged to the outside of the image forming apparatus 1, the sheet that has passed through the fixing unit 11 is conveyed to the post-processing apparatus 4 through a conveyance path 14. In a case where double-sided printing is performed on the sheet, the sheet on which image formation on the first surface is completed passes through the fixing unit 11 and is then delivered to reverse rollers 12, and switchback conveyance is performed by the reverse rollers 12. As a result, the sheet is conveyed to the registration rollers 7 again through a conveyance path 13. Subsequently, when the sheet is conveyed to the transfer unit, the image formed by the image forming unit 1B is transferred onto the second surface of the sheet. The sheet on which image formation on the second surface is completed passes through the fixing unit 11 and is then conveyed to the post-processing apparatus 4 through the conveyance path 14.

The image forming unit 1B may be configured to perform image formation by an intermediate transfer system in which a toner image formed on a photosensitive member is transferred to a sheet via an intermediate transfer member. The image forming unit 1B may be configured to perform image formation by an inkjet method or an offset printing method.

<Post-Processing Apparatus>

The post-processing apparatus 4 includes a binding processing unit 4A that performs binding processing as post-processing (sheet processing) on sheets. The post-processing apparatus 4 performs the binding processing on the sheets conveyed from the image forming apparatus 1 by the binding processing unit 4A, and discharges a plurality of the bound sheets as a sheet bundle. Further, the post-processing apparatus 4 can also discharge the sheet conveyed from the image forming apparatus 1 without performing the binding processing.

The post-processing apparatus 4 includes an entry path 81, an inner discharge path 82, a first discharge path 83, and a second discharge path 84 as conveyance paths for conveying sheets. The post-processing apparatus 4 includes an upper discharge tray 25 and a lower discharge tray 37 as discharge destinations to which sheets are discharged. The entry path 81 is a conveyance path for conveying a sheet received from the image forming apparatus 1. The inner discharge path 82 is a conveyance path for conveying the sheet toward the binding processing unit 4A. The first discharge path 83 is a conveyance path for discharging the sheet to the upper discharge tray 25. The second discharge path 84 is a conveyance path for discharging the sheet to the lower discharge tray 37.

In the entry path 81, inlet rollers 21, an inlet sensor 27, and pre-buffer rollers 22 are arranged in this order in the sheet conveyance direction. Reverse rollers 24 are arranged on the first discharge path 83. Inner discharge rollers 26, intermediate conveyance rollers 28, kick-out rollers 29, and a pre-intermediate stack sensor 38 are arranged on the inner discharge path 82. Bundle discharge rollers 36 are arranged on the second discharge path 84. Both of the inlet sensor 27 and the pre-intermediate stack sensor 38 detect the sheet during conveyance at predetermined detection positions in the conveyance paths in the post-processing apparatus 4. These sensors may be configured by optical sensors that detect presence or absence of a sheet at the detection positions using light.

Hereinafter, a path where a sheet is conveyed in the post-processing apparatus 4 will be described. The sheet discharged from the image forming apparatus 1 through the conveyance path 14 is taken into the post-processing apparatus 4 by the inlet rollers 21, and is conveyed toward the pre-buffer rollers 22 in the entry path 81. The sheet during conveyance in the entry path 81 is detected by the inlet sensor 27 at a detection position between the inlet rollers 21 and the pre-buffer rollers 22. The pre-buffer rollers 22 convey the sheet conveyed by the inlet rollers 21 toward the first discharge path 83.

When the upper discharge tray 25 is designated as the discharge destination of the sheet, the reverse rollers 24 discharge the sheet guided to the first discharge path 83 by the pre-buffer rollers 22 to the upper discharge tray 25. When the lower discharge tray 37 is designated as the discharge destination of the sheet, switchback conveyance is performed on the sheet guided to the first discharge path 83 by the pre-buffer rollers 22 to guide the sheet to the inner discharge path 82. A flapper 23 is arranged at a branch point (switchback branch point) where the entry path 81 and the inner discharge path 82 branch from the first discharge path 83 on the upstream side of the reverse rollers 24 in the sheet discharge direction to the upper discharge tray 25 by the reverse rollers 24. The flapper 23 has a function of regulating conveyance of the sheet on which switchback conveyance has been performed by the reverse rollers 24 to the entry path 81.

The inner discharge rollers 26, the intermediate conveyance rollers 28, and the kick-out rollers 29 arranged on the inner discharge path 82 convey the sheet guided to the inner discharge path 82 by the reverse rollers 24 toward the binding processing unit 4A while delivering the sheet in sequence. The sheet during conveyance in the inner discharge path 82 is detected by the pre-intermediate stack sensor 38 at a detection position between the intermediate conveyance rollers 28 and the kick-out rollers 29.

The binding processing unit 4A includes a stapler 51. The binding processing unit 4A performs alignment processing on a plurality of sheets (sheet bundle) conveyed through the inner discharge path 82 and stacked on the intermediate stacking portion, and then binds predetermined positions of the plurality of sheets by the stapler 51. Detailed configuration and operation of the binding processing unit 4A will be described later. The sheet bundle bound by the binding processing unit 4A is delivered to the bundle discharge rollers 36 through the second discharge path 84 by slide motion of a bundle discharge guide 34 as a first conveying mechanism of the binding processing unit 4A. Subsequently, the sheet bundle is discharged to the lower discharge tray 37 by the bundle discharge rollers 36 as a second conveying mechanism of the binding processing unit 4A.

Both the upper discharge tray 25 and the lower discharge tray 37 are movable in the top-bottom direction with respect to a housing of the post-processing apparatus 4. The post-processing apparatus 4 includes a sheet sensor that detects the positions of the upper surfaces of the plurality of sheets (heights from the surfaces of the trays) stacked on the upper discharge tray 25 and the lower discharge tray 37. Based on the detection result of the sheet sensor provided in the upper discharge tray 25, the lift up/down control of the upper discharge tray 25 is performed in the top-bottom direction (an A1 direction or an A2 direction) such that the position of the upper surface of the sheets stacked on the upper discharge tray 25 is kept constant. Further, based on the detection result of the sheet sensor provided in the lower discharge tray 37, lift up/down control of the lower discharge tray 37 in the top-bottom direction (a B1 direction or a B2 direction) is performed such that the position of the upper surface of the sheets stacked on the lower discharge tray 37 is kept constant. In the present embodiment, each of the lift up/down control of the upper discharge tray 25 and the lower discharge tray 37 is performed by motor driving, but, for example, may be performed by a biasing mechanism, such as a spring.

<Binding Processing Unit>

Figure 2A:
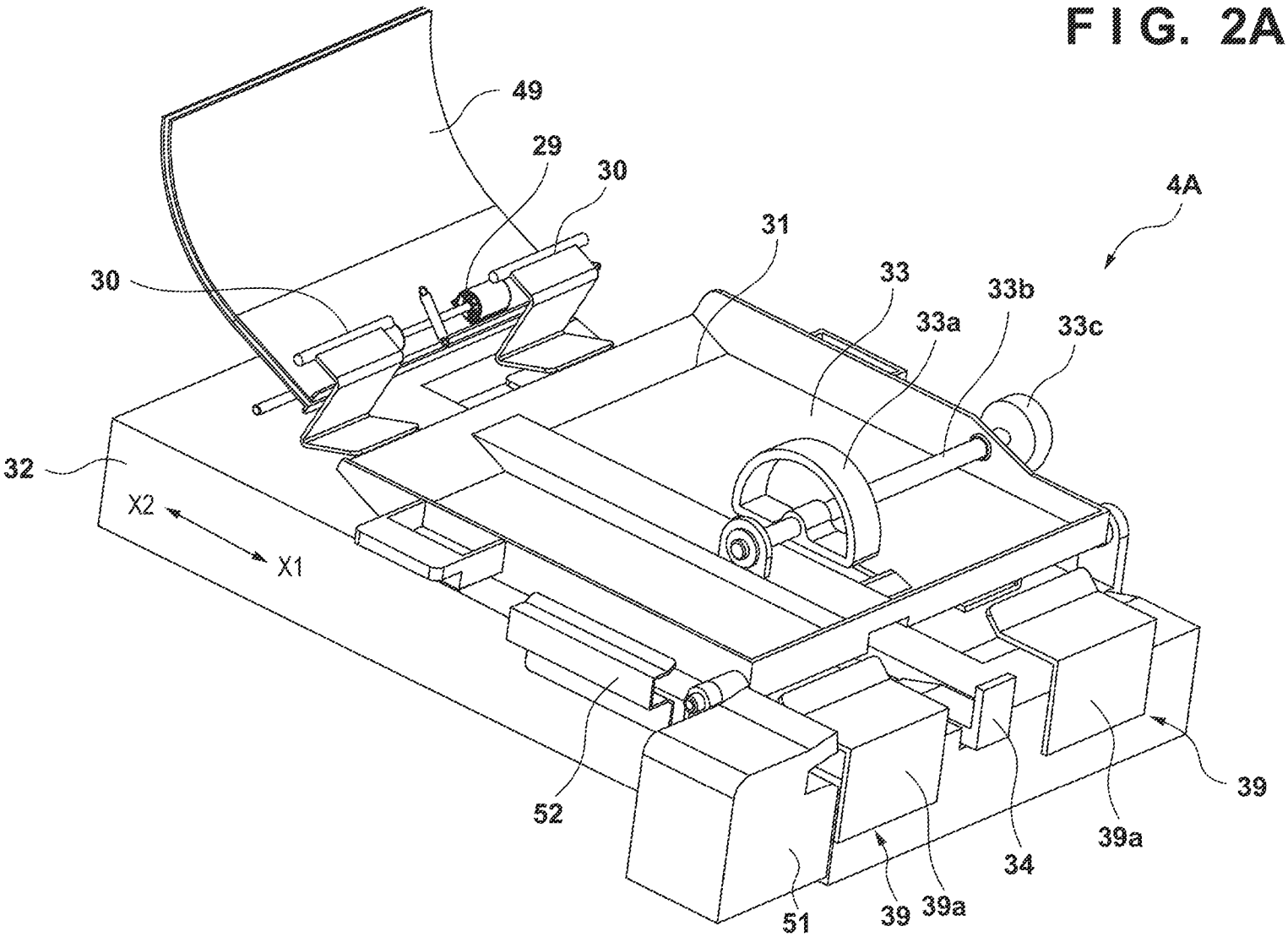
FIGS. 2A and 2B are perspective views illustrating a configuration example of a binding processing unit.

Next, the configuration and the operation of the binding processing unit 4A is described with reference to FIGS. 2A and 2B. FIG. 2A is a perspective view illustrating the binding processing unit 4A, and FIG. 2B is a perspective view illustrating the binding processing unit 4A in a state in which a part of a member (intermediate upper guide 31) is opened.

Figure 2B:
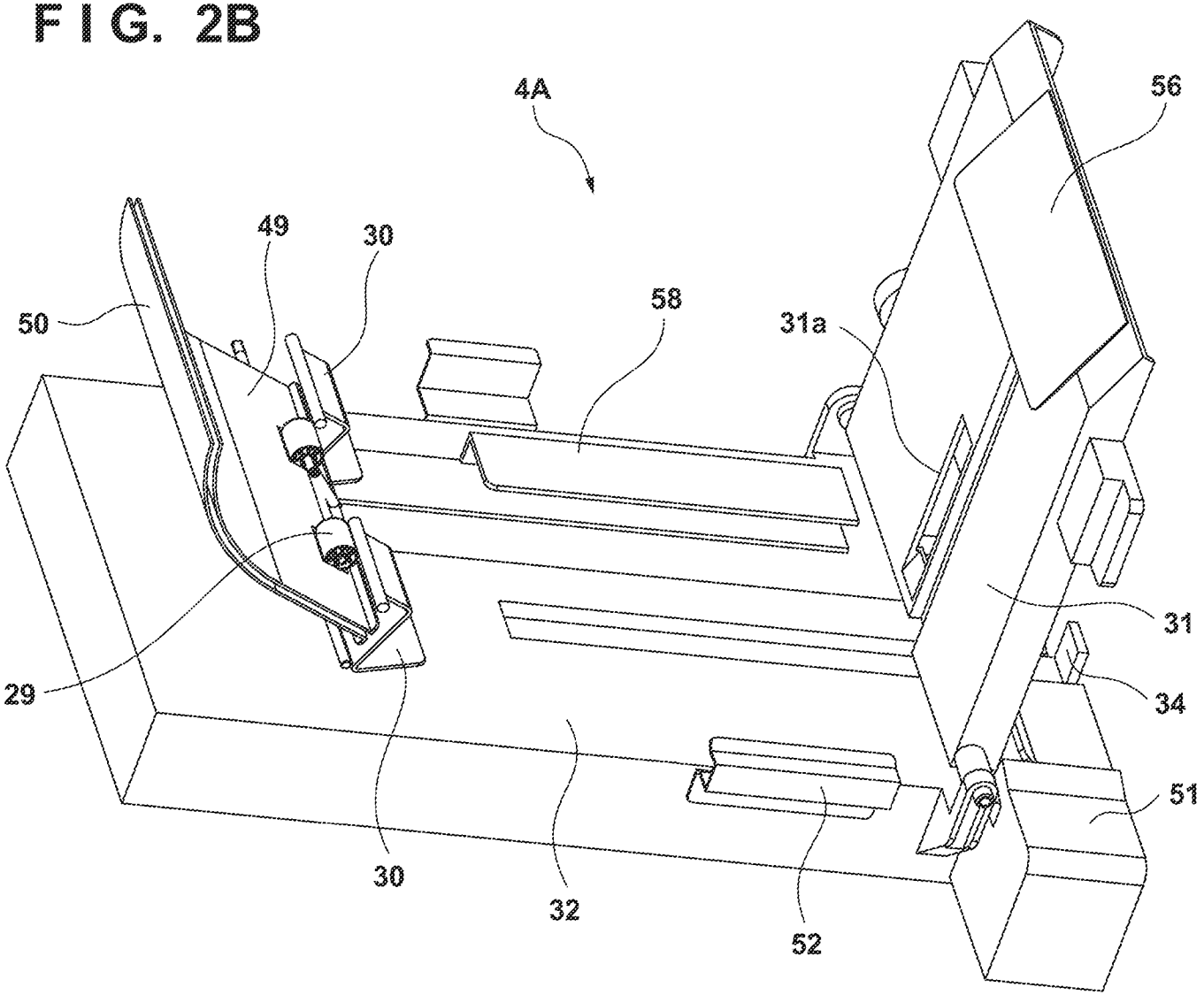

As illustrated in FIGS. 2A, 2B, and 1, the binding processing unit 4A includes the stapler 51, the intermediate upper guide 31, an intermediate lower guide 32, longitudinal alignment reference plates 39, a longitudinal alignment roller 33, and the bundle discharge guide 34. The binding processing unit 4A performs binding processing on the sheets discharged from the inner discharge path 82 and stacked on the intermediate stacking portion with the stapler 51 to form a bound sheet bundle.

The intermediate upper guide 31 and the intermediate lower guide 32 configure the intermediate stacking portion on which sheets to be processed are stacked. The intermediate lower guide 32 serves as the stacking portion on which the sheets discharged from the inner discharge path 82 by the kick-out rollers 29, which are arranged at the most downstream position in the inner discharge path 82, are stacked. As described above, the intermediate stacking portion is an example of the stacking portion on which sheets targeted for sheet processing (binding processing) are stacked.

A bundle pressing flag 30 is rotatably provided on the downstream side of the kick-out rollers 29 in the sheet conveyance direction. A lower surface of the bundle pressing flag 30 presses a rear end portion of a sheet (preceding sheet) previously discharged from the inner discharge path 82 to the intermediate stacking portion. As a result, the distal end of the sheet (subsequent sheet) discharged later by the kick-out rollers 29 passes through above the rear end of the preceding sheet. As described above, the bundle pressing flag 30 has a function of preventing the sheets from colliding with one another in the intermediate stacking portion by moving the rear end portion of the sheet discharged from the inner discharge path 82 downward by the kick-out rollers 29. The lower surface of the bundle pressing flag 30 is provided in the range of the sheet width such that both end portions of the sheet in the sheet width direction can be pressed according to the size of the sheet that can be processed in the binding processing unit 4A.

The longitudinal alignment roller 33 is arranged above the intermediate lower guide 32. The longitudinal alignment roller 33 is formed of an elastic material, such as synthetic rubber or elastomer resin, and includes a roller portion 33*a* whose outer peripheral surface is adjusted to have a predetermined friction coefficient. The roller portion 33*a* is supported to a shaft portion 33*b* rotatably supported by the intermediate upper guide 31. The roller portion 33*a* is driven by a drive transmission device including a gear unit 33*c* so as to intermittently rotate by one rotation. The roller portion 33*a* as the outer peripheral portion of the longitudinal alignment roller 33 has a non-circular shape when viewed in the axial direction of the shaft portion 33*b*. In a standby state before the sheet is discharged to the intermediate stacking portion, the longitudinal alignment roller 33 is held at a rotation angle at which the roller portion 33*a* is not exposed from the intermediate upper guide 31. Further, during one rotation of the longitudinal alignment roller 33, the roller portion 33*a* is temporarily exposed from an opening portion 31*a* provided in the intermediate upper guide 31 and contacts the upper surface of the sheets stacked on the intermediate lower guide 32 to apply a conveying force. A contact pressure of the longitudinal alignment roller 33 against the sheet is adjusted such that the longitudinal alignment roller 33 slips after the sheet abuts on the longitudinal alignment reference plates 39.

A holding guide 56 as a flexible sheet member is arranged in the intermediate stacking portion. The holding guide 56 is arranged so as to abut on the intermediate lower guide 32 and presses the upper surface of the sheets stacked on the intermediate stacking portion with a predetermined pressing force.

The longitudinal alignment reference plates 39 are provided downstream of the longitudinal alignment roller 33 in the sheet discharge direction when the sheet is discharged from the inner discharge path 82 by the kick-out rollers 29. The longitudinal alignment reference plates 39 include reference walls 39*a* protruding upward from the upper surface of the intermediate lower guide 32 as regulating members that abut on the end portion of the sheet. The two longitudinal alignment reference plates 39 are provided on both sides in a direction orthogonal to the sheet discharge direction (the width direction of the sheet).

Hereinafter, in the binding processing unit 4A, a direction in which the sheet discharged from the inner discharge path 82 by the kick-out rollers 29 moves toward the longitudinal alignment reference plates 39 is referred to as a "longitudinal alignment direction X1." The longitudinal alignment direction X1 is a direction along the sheet conveyance direction in the inner discharge path 82 and a direction in which the longitudinal alignment roller 33 moves the sheet toward the longitudinal alignment reference plates 39. A direction opposite to the longitudinal alignment direction X1 (that is, a direction in which the sheet bundle is discharged from the binding processing unit 4A) is referred to as a "bundle discharge direction X2."

The stapler 51 performs the binding processing of binding predetermined positions of a plurality of sheets stacked on the intermediate stacking portion and aligned in the longitudinal alignment direction X1 and the sheet width direction. The stapler 51 is provided on the same side as a transverse alignment reference plate 52 in the sheet width direction, and is provided to be movable in the longitudinal alignment direction X1 and the bundle discharge direction X2. Further, the intermediate lower guide 32 has an area that allows stacking legal-sized sheets conveyed in a long side feeding direction (a conveyance direction in which the longitudinal alignment direction X1 becomes the long side direction and the sheet width direction becomes the short side direction). Therefore, the stapler 51 can perform not only corner binding for binding the corner portion of the sheet bundle stacked on the intermediate stacking portion but also a long side binding operation for binding a plurality of positions along the long side of the sheet bundle while the stapler 51 moves with respect to the sheet bundle.

In the binding processing unit 4A of the present embodiment, the longitudinal alignment roller 33 and the longitudinal alignment reference plates 39 configure an alignment processing unit (alignment unit) that performs alignment processing for aligning the positions of the sheets in the sheet conveyance direction on the sheet bundle stacked on the stacking portion. The longitudinal alignment roller 33 is an example of an alignment roller that is rotationally driven to move the sheet in the conveyance direction, and the longitudinal alignment reference plates 39 are an example of first reference plates provided along the width direction orthogonal to the conveyance direction. The stapler 51 is an example of a processing unit that performs sheet processing (binding processing) on the sheet bundle on which the alignment processing has been performed.

<Generation Processing of Sheet Bundle in Imbricated State>

The post-processing apparatus 4 of the present embodiment causes the subsequent sheet conveyed from the image forming apparatus 1 to stand by in the inner discharge path 82 and the first discharge path 83 (buffer section) to prevent the subsequent sheet from being conveyed to the binding processing unit 4A during execution of the binding processing by the binding processing unit 4A. At this time, the post-processing apparatus 4 causes a plurality of subsequent sheets to stand by in a state of the sheets being overlapped in sequence. Subsequently, the post-processing apparatus 4 conveys the sheet bundle in which the plurality of sheets are overlapped from the buffer section to the binding processing unit 4A (intermediate stacking portion). This makes it possible to continue the image formation by the image forming apparatus 1 during execution of the binding processing by the binding processing unit 4A (the post-processing by the post-processing apparatus 4), thereby ensuring preventing a decrease in productivity of the image forming system.

When the plurality of sheets are overlapped, the post-processing apparatus 4 generates a sheet bundle in an imbricated state by overlapping the plurality of sheets in a state where the positions of the plurality of sheets are shifted in sequence in the sheet conveyance direction in the buffer section. As a result, the binding processing unit 4A can perform longitudinal alignment on the plurality of overlapped sheets. Hereinafter, generation processing of a sheet bundle in the imbricated state will be described with reference to FIGS. 3A to 3D.

The post-processing apparatus 4 guides a sheet P1 guided to the first discharge path 83 to the inner discharge path 82 by switchback conveyance by the reverse rollers 24, and stops the reverse rollers 24 and the inner discharge rollers 26 after the sheet P1 reaches the inner discharge rollers 26. As a result, the sheet P1 is stopped at a position illustrated in FIG. 3A. At this time, the post-processing apparatus 4 separates the roller pair of the reverse rollers 24.

Figure 3B:
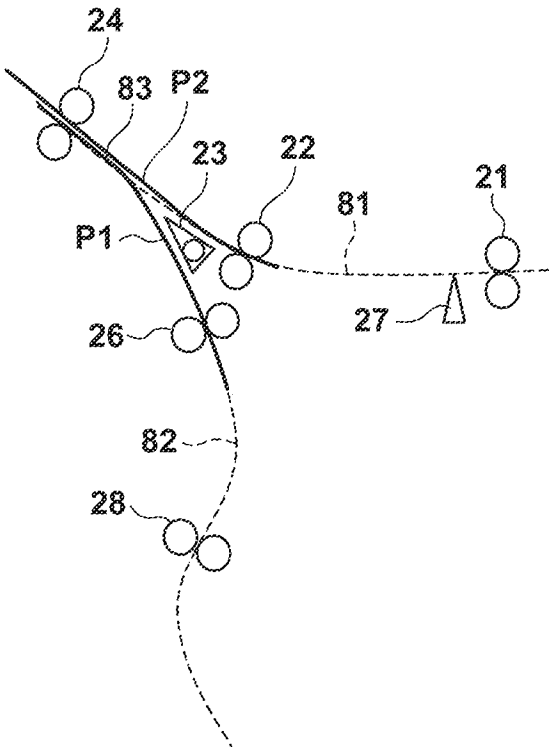
FIGS. 3A to 3D are cross-sectional views illustrating an example of generating a sheet bundle in an imbricated state in a buffer section.

Subsequently, the inlet sensor 27 detects a rear end of a sheet P2 conveyed next to the sheet P1. The post-processing apparatus 4 brings the roller pair of the reverse rollers 24 into abutment with the sheet P2 after a predetermined time elapses from a timing as a reference at which the rear end of the sheet P2 is detected by the inlet sensor 27 (FIG. 3B). Further, the post-processing apparatus 4 starts rotational driving of the reverse rollers 24 and the inner discharge rollers 26 such that the sheets P1 and P2 are conveyed in the direction of the upper discharge tray 25.

Here, the above-described predetermined time is a time for determining the shift amount of the position in the sheet conveyance direction when the sheet P2 is overlapped with the sheet P1. When this time is lengthened, the shift amount of the sheet becomes large, and when this time is shortened, the shift amount of the sheet becomes small. As will be described later, the post-processing apparatus 4 of the present embodiment controls (sets) the shift amount of the sheet according to the size of the sheet to be processed such that the productivity of the post-processing apparatus 4 is improved while the accuracy of alignment processing of the sheet is maintained (the shift amount required for longitudinal alignment is ensured).

Figure 3A:
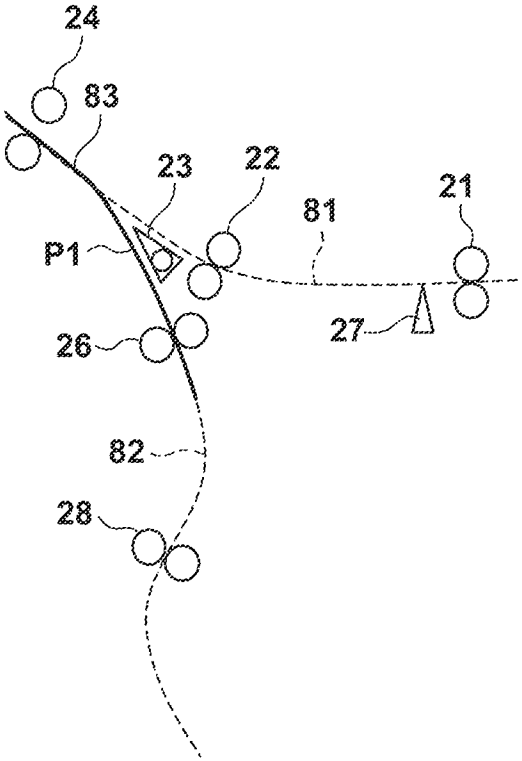
Figure 3D:
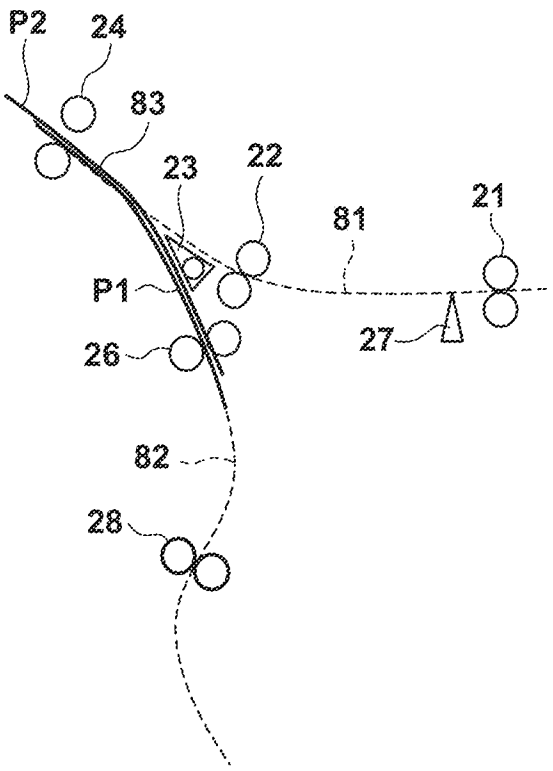
Figure 3C:
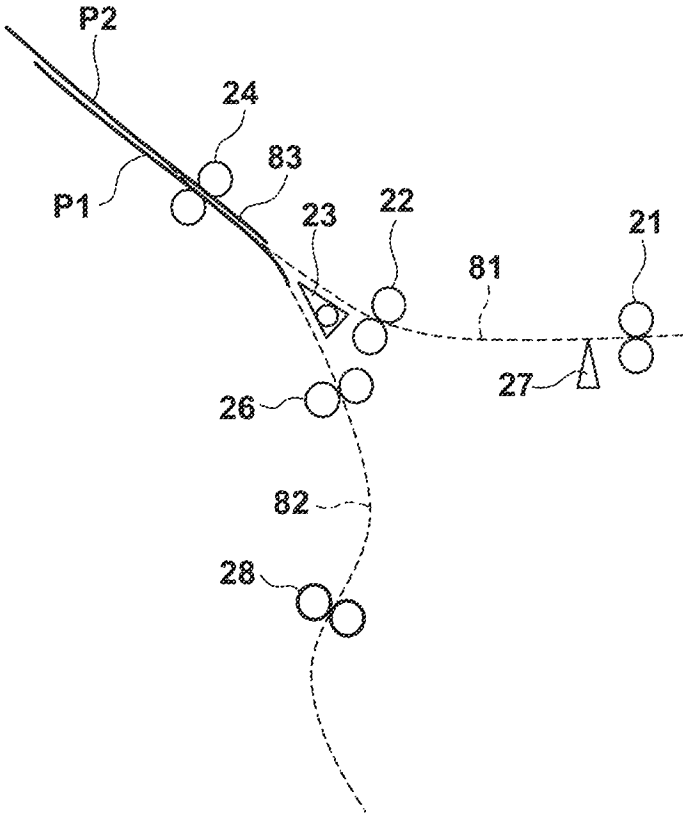

As illustrated in FIG. 3C, at the timing when the rear end of the sheet P2 reaches the switchback branch point, the post-processing apparatus 4 rotationally drives the reverse rollers 24 and the inner discharge rollers 26 such that the rotation directions of the reverse rollers 24 and the inner discharge rollers 26 are reversed. Accordingly, the sheets P1 and P2 are guided to the inner discharge path 82 and conveyed in the direction of the binding processing unit 4A.

After the sheet P2 guided to the inner discharge path 82 reaches the inner discharge rollers 26, the post-processing apparatus 4 stops the reverse rollers 24 and the inner discharge rollers 26. As a result, the sheets P1 and P2 are stopped at the positions illustrated in FIG. 3D. At this time, the post-processing apparatus 4 further separates the roller pair of the reverse rollers 24.

In this way, as illustrated in FIG. 3D, a sheet bundle in an imbricated state formed of two sheets is generated in the inner discharge path 82 and the first discharge path 83. Further, by repeating the above-described processing, it is possible to generate the sheet bundle in the imbricated state formed of three or more sheets. In this way, the post-processing apparatus 4 generates the sheet bundle (the sheet bundle in the imbricated state) in which the positions of the sheets conveyed on the conveyance paths are shifted in sequence to the upstream side in the sheet conveyance direction and overlapped in the buffer section.

During execution of the binding processing by the binding processing unit 4A, the post-processing apparatus 4 holds a plurality of subsequent sheets conveyed from the image forming apparatus 1 in the inner discharge path 82 and the first discharge path 83 as the sheet bundle in the imbricated state generated as described above. The post-processing apparatus 4 uses the inner discharge path 82 and the first discharge path 83 as the buffer section for holding the plurality of subsequent sheets conveyed from the image forming apparatus 1.

<Longitudinal Alignment of Sheet Bundle>

FIGS. 4A to 4D are schematic diagrams illustrating an example of longitudinal alignment of the sheet bundle formed of three sheets in the intermediate stacking portion. Here, the longitudinal alignment is processing (alignment processing) for aligning positions of a plurality of sheets in the sheet conveyance direction. When the sheet bundle in the imbricated state is fed in the binding processing unit 4A through the inner discharge path 82, the post-processing apparatus 4 starts the rotational driving of the longitudinal alignment roller 33 to start the longitudinal alignment on the sheet bundle stacked on the intermediate stacking portion in the binding processing unit 4A.

Figure 4A:
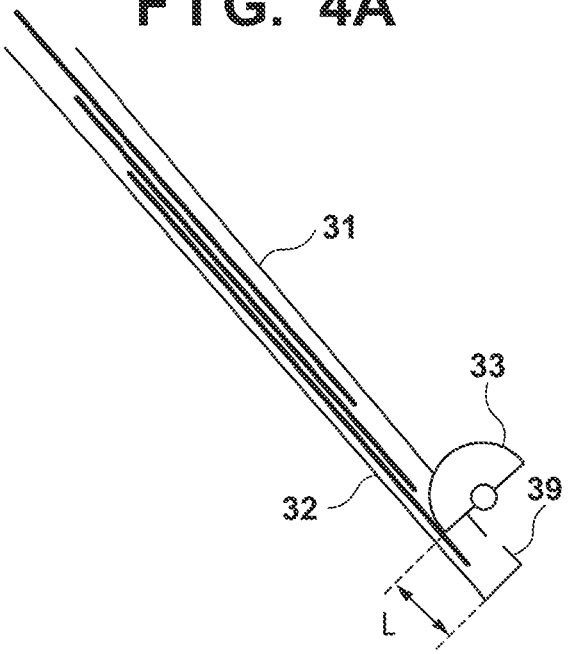
FIGS. 4A to 4D illustrate an example of longitudinal alignment of a sheet bundle in the binding processing unit.

FIG. 4A illustrates a state in which the sheet bundle in the imbricated state discharged from the inner discharge path 82 is stacked on the intermediate stacking portion. The intermediate stacking portion includes the intermediate upper guide 31 and the intermediate lower guide 32. The intermediate stacking portion is provided with the longitudinal alignment roller 33 and the longitudinal alignment reference plates 39 as members used for longitudinal alignment. The plurality of sheets constituting the sheet bundle are abutted against the longitudinal alignment reference plates 39 in sequence by the longitudinal alignment roller 33, whereby longitudinal alignment (alignment processing in the sheet conveyance direction) of the sheet bundle is performed.

Figure 4B:
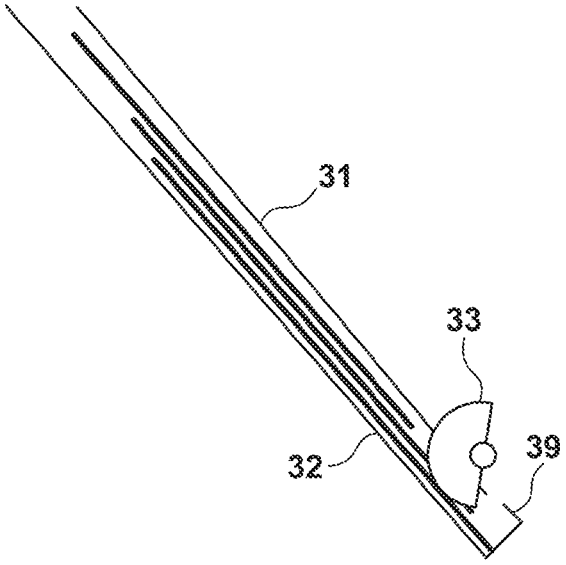
Figure 4C:
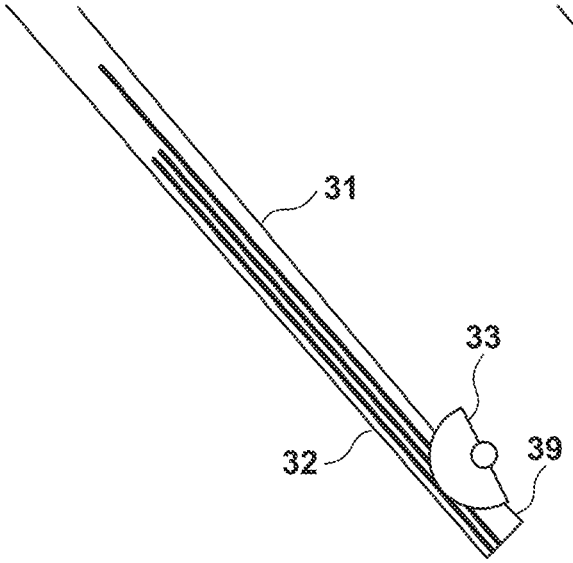
Figure 4D:
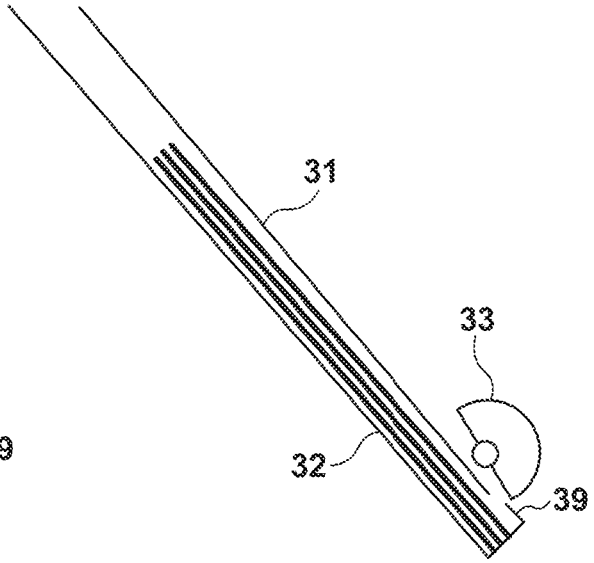

First, as illustrated in FIG. 4B, the sheet at the lowermost portion (lowest) of the sheet bundle stacked on the intermediate stacking portion is abutted against the longitudinal alignment reference plates 39 by the longitudinal alignment roller 33. Next, as illustrated in FIG. 4C, the second sheet from the bottom of the sheet bundle is abutted against the longitudinal alignment reference plates 39 by the longitudinal alignment roller 33. Further, as illustrated in the FIG. 4D, the sheet at the uppermost portion (top) of the sheet bundle is abutted against the longitudinal alignment reference plates 39 by the longitudinal alignment roller 33. Thus, the longitudinal alignment of the sheet bundle stacked on the intermediate stacking portion is completed.

In the present embodiment, the post-processing apparatus 4 generates the sheet bundle in which the positions of the sheets conveyed on the conveyance paths are shifted to the upstream side in sequence in the sheet conveyance direction and overlapped in the buffer section and feeds the generated sheet bundle in the binding processing unit 4A (intermediate stacking portion). Thus, in the intermediate stacking portion, each sheet of the sheet bundle is caused to abut against the longitudinal alignment reference plates 39 by the longitudinal alignment roller 33, whereby the longitudinal alignment can be performed on all sheets of the sheet bundle. As described above, the alignment processing unit configured by the longitudinal alignment roller 33 and the longitudinal alignment reference plates 39 moves the sheets of the sheet bundle stacked on the intermediate stacking portion one by one in sequence from the bottom to the downstream in the sheet conveyance direction by the longitudinal alignment roller 33, and brings the end portions of the respective sheets into abutment against the longitudinal alignment reference plates 39. As a result, the alignment processing unit performs alignment processing (longitudinal alignment) on the sheet bundle in the sheet conveyance direction.

The shift amount of the sheet when the sheet bundle in the imbricated state is generated in the buffer section is determined based on a distance L between the position where the longitudinal alignment roller 33 contacts the sheet and the position of the longitudinal alignment reference plates 39, a distance required for the longitudinal alignment, and a distance in consideration of, for instance, friction between the sheets. When the sizes of the sheets to be processed are small (the surface areas are small), the frictional force between the sheets to be overlapped is small, and required longitudinal alignment capability is low. That is, even when the shift amount of the positions between the overlapped sheets is small, the accuracy of the alignment processing can be maintained. Therefore, it is possible to reduce the shift amount of the sheet.

Therefore, by setting the shift amount to be smaller the smaller the size of the sheet conveyed on the conveyance path is, it is possible to improve the productivity of the sheet processing apparatus by shortening the time required for the alignment processing while the accuracy of the sheet alignment processing is maintained. For instance, as described below, the shift amount of the sheet is set such that the shift amount when the size of the sheet to be processed conveyed on the conveyance paths is a threshold size or less is smaller than the shift amount when the size is not the threshold size or less. For instance, in a case where L=20 [mm], When the sheet size is a small size (210 mm or less of the length of the sheet in the conveyance direction and 148 mm or less of the width of the sheet in the width direction), the shift amount is set to 25 mm.

When the sheet size is not the small size, the shift amount is set to 30 mm.

In the above example, whether the size of the sheet is the threshold size or less is determined based on the length and the width of the sheet to be processed, but the determination may be performed based on at least any of the length of the sheet and the width of the sheet. In addition, although an example in which the two stages of setting are provided as the settings of the shift amount of the position of the sheet has been described, three or more stages of setting associated with size ranges of respective different sheets may be provided.

<Configuration of Image Forming System>

Figure 5:
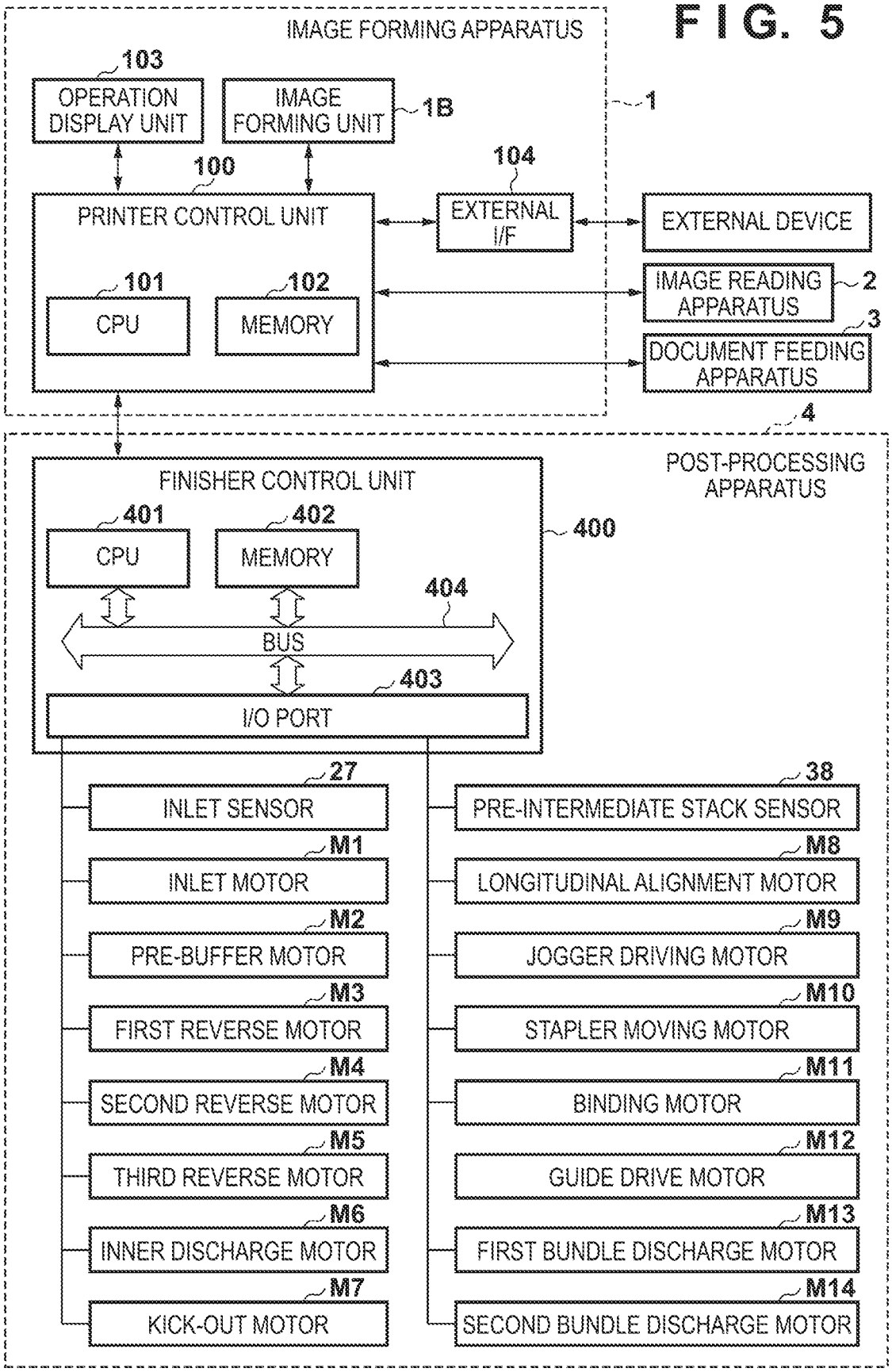
FIG. 5 is a block diagram illustrating a hardware configuration example of the image forming system.

FIG. 5 is a block diagram illustrating a hardware configuration example of the image forming system 1S according to the present embodiment. The image forming apparatus 1 includes the printer control unit 100, and the post-processing apparatus 4 includes a finisher control unit 400. The printer control unit 100 and the finisher control unit 400 are connected to one another via a communication interface, and cooperate with one another to control the operation of the image forming system 15.

The printer control unit 100 includes a central processing unit (CPU) 101 and a memory 102. The CPU 101 reads and executes a program stored in the memory 102 to integrally control the image forming apparatus 1. For instance, the CPU 101 performs processing of causing the image forming unit 1B to perform the image forming operation and processing of causing the image reading apparatus 2 to perform a reading operation to acquire image data. The memory 102 includes a non-volatile storage medium, such as a read-only memory (ROM), and a volatile storage medium, such as a random access memory (RAM), and is used as a storage location for programs and data and as a working space when the CPU 101 executes programs. The memory 102 is an example of the non-transitory storage medium that stores a program for controlling the image forming apparatus 1.

The printer control unit 100 is connected to an external device, such as a personal computer (PC) and a portable information device, via an external interface (I/F) 104. The printer control unit 100 receives various jobs, such as an image forming job (print job), from an external device via an external I/F 104. The printer control unit 100 is connected to an operation display unit 103, which is a user interface of the image forming system 1S. The operation display unit 103 includes a display device, such as a liquid crystal panel, for presenting information to a user and an input device, such as a physical button and a touch panel function unit of the liquid crystal panel, for receiving an input operation by the user. The printer control unit 100 communicates with the operation display unit 103 to control display content of the display device and receive information input via the input device.

The finisher control unit 400 includes a CPU 401, a memory 402, and an input/output (I/O) port 403. The CPU 401 reads and executes a program stored in the memory 402 to integrally control the post-processing apparatus 4. The memory 402 includes a non-volatile storage medium, such as a ROM, and a volatile storage medium, such as a RAM, and is used as a storage location for programs and data and as a working space when the CPU 401 executes programs. The memory 402 is an example of the non-transitory storage medium that stores a program for controlling the post-processing apparatus 4.

Each function provided with the printer control unit 100 and the finisher control unit 400 may be implemented on a circuit of the control unit as independent hardware, such as an ASIC, or may be implemented by software as a function unit of a program. Some or all of the functions of the finisher control unit 400 described below can be implemented as the functions of the printer control unit 100.

The CPU 401 and the memory 402 are connected to the I/O port 403 via a bus 404. The I/O port 403 inputs and outputs a control signal between the CPU 401 and the memory 402 and each of the devices constituting the post-processing apparatus 4. In addition to the inlet sensor 27 and the pre-intermediate stack sensor 38, a plurality of motors (M1 to M14) serving as driving sources for conveying sheets or driving sources of the binding processing unit 4A are connected to the I/O port 403.

The inlet motor M1 rotationally drives the inlet rollers 21. The pre-buffer motor M2 rotationally drives the pre-buffer rollers 22. The first reverse motor M3 rotationally drives the reverse rollers 24. The second reverse motor M4 brings the roller pair of the reverse rollers 24 into abutment with one another by rotational driving in a first direction (for instance, a clockwise direction (CW direction)), and separates the roller pair of the reverse rollers 24 by rotational driving in a direction (counterclockwise direction (CCW direction)) opposite to the first direction. The third reverse motor M5 moves the roller pair of the reverse rollers 24 in a first direction (a direction toward the front side) among two directions orthogonal to the conveyance direction by rotational driving in the CW direction, and moves the roller pair of the reverse rollers 24 in a direction (a direction toward the back side) opposite to the first direction by rotational driving in the CCW direction.

The inner discharge motor M6 rotationally drives the inner discharge rollers 26. The kick-out motor M7 rotationally drives the kick-out rollers 29. The longitudinal alignment motor M8 supplies a driving force for intermittently operating the longitudinal alignment roller 33 by one rotation. The jogger driving motor M9 moves a transverse alignment jogger 58 in the sheet width direction. The stapler moving motor M10 moves the stapler 51 in the longitudinal alignment direction X1 and the bundle discharge direction X2. The binding motor M11 causes the stapler 51 to perform an operation of binding the sheet bundle.

The guide drive motor M12 drives a guide drive unit 35 to slide and move the bundle discharge guide 34. The guide drive motor M12 moves the bundle discharge guide 34 in the longitudinal alignment direction X1 by rotational drive in the CW direction, and moves it in the bundle discharge direction X2 by rotational drive in the CCW direction. The first bundle discharge motor M13 rotationally drives the bundle discharge rollers 36. The second bundle discharge motor M14 brings the roller pair of the bundle discharge rollers 36 into abutment with one another by rotational driving in the CW direction, and separates the roller pair of the bundle discharge rollers 36 by rotational driving in the CCW direction.

<Configuration of Control Unit>

Figure 6:
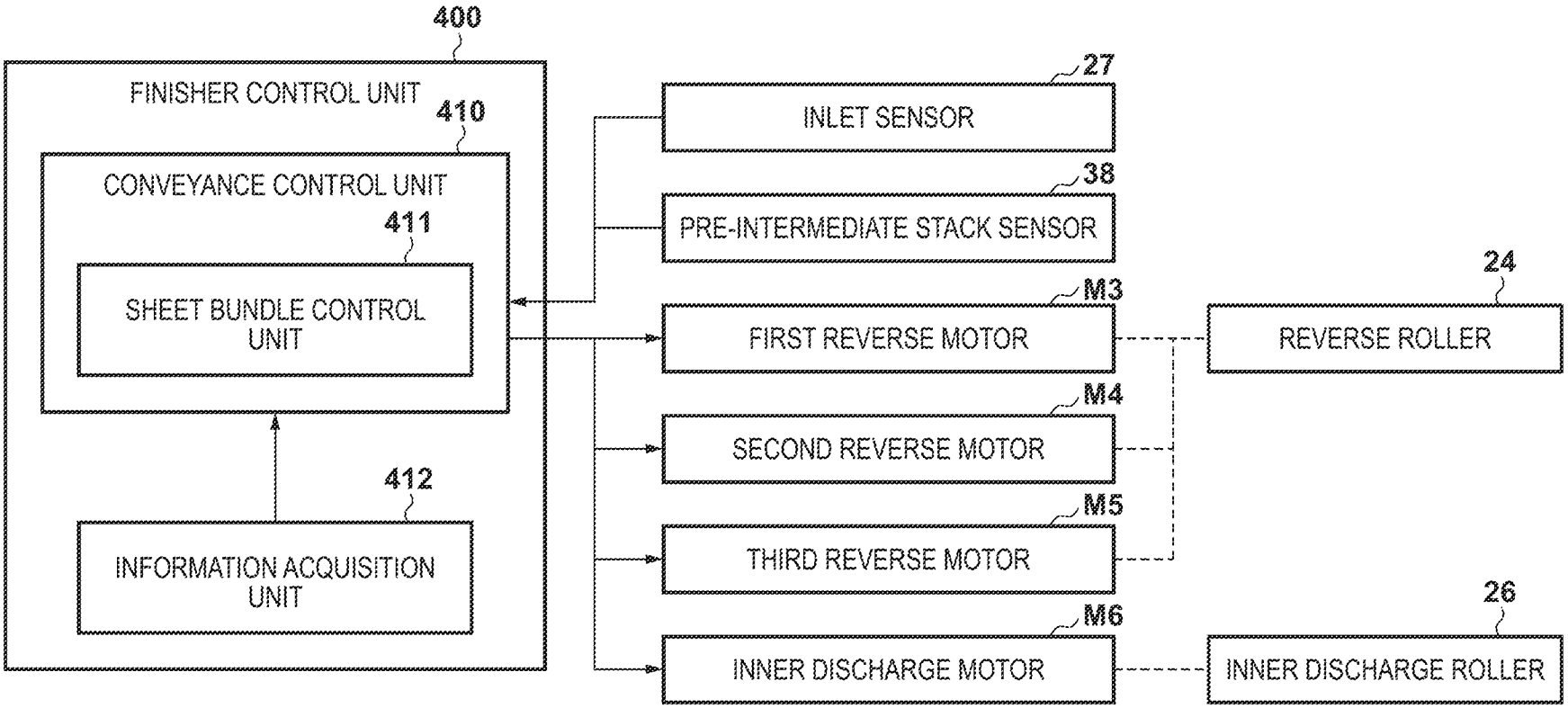
FIG. 6 is a block diagram illustrating a functional configuration example of the image forming system.

FIG. 6 is a block diagram illustrating a functional configuration example of the image forming system 1S according to the present embodiment. FIG. 6 mainly illustrates functional blocks associated with sheet conveyance control in the post-processing apparatus 4 of the present embodiment, and functional blocks associated with other functions are omitted.

The finisher control unit 400 includes a conveyance control unit 410 and an information acquisition unit 412, and the conveyance control unit 410 includes a sheet bundle control unit 411. The functions of the respective control units 410 to 412 are achieved by the CPU 401 in the finisher control unit 400 (FIG. 5) executing a program read from the memory 402.

The conveyance control unit 410 drives the respective motors M1 to M14 to be controlled based on information output from various sensors, such as the inlet sensor 27 and the pre-intermediate stack sensor 38, thereby controlling the conveyance of the sheet on the conveyance path in the post-processing apparatus 4. The sheet bundle control unit 411 drives the first reverse motor M3, the second reverse motor M4, and the inner discharge motor M6 based on the information output from the inlet sensor 27 and the information acquisition unit 412 to control generation of the sheet bundle in the imbricated state in the buffer section. The information acquisition unit 412 acquires information (for instance, a sheet size) set via the operation display unit 103 via the printer control unit 100.

<Processing Procedure>

Figure 7:
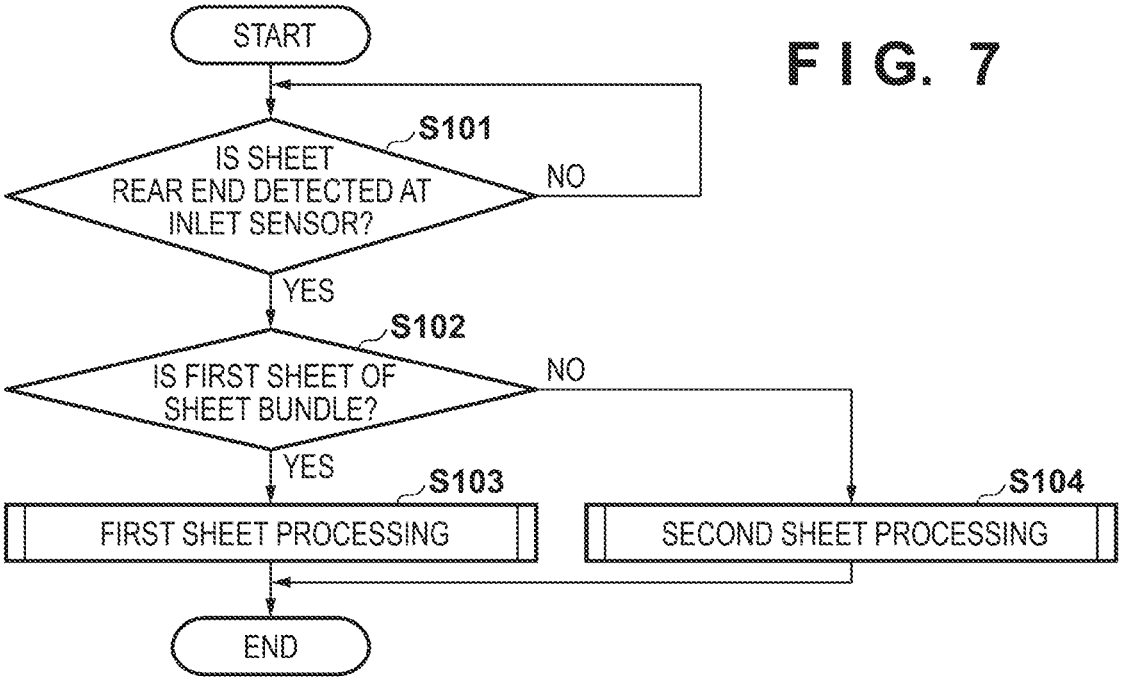
FIG. 7 is a flowchart depicting a processing procedure for conveyance control of a sheet.
Figure 8:
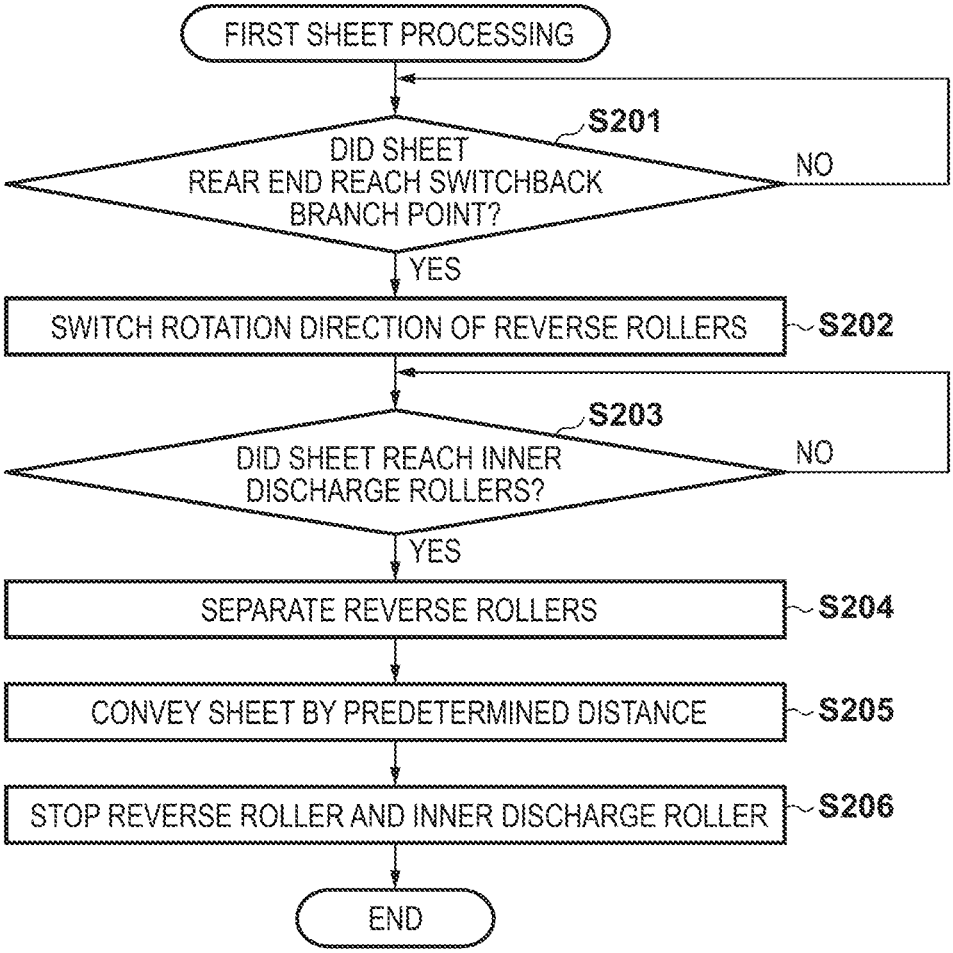
FIG. 8 is a flowchart depicting a procedure of first sheet processing (S103)
Figure 9:
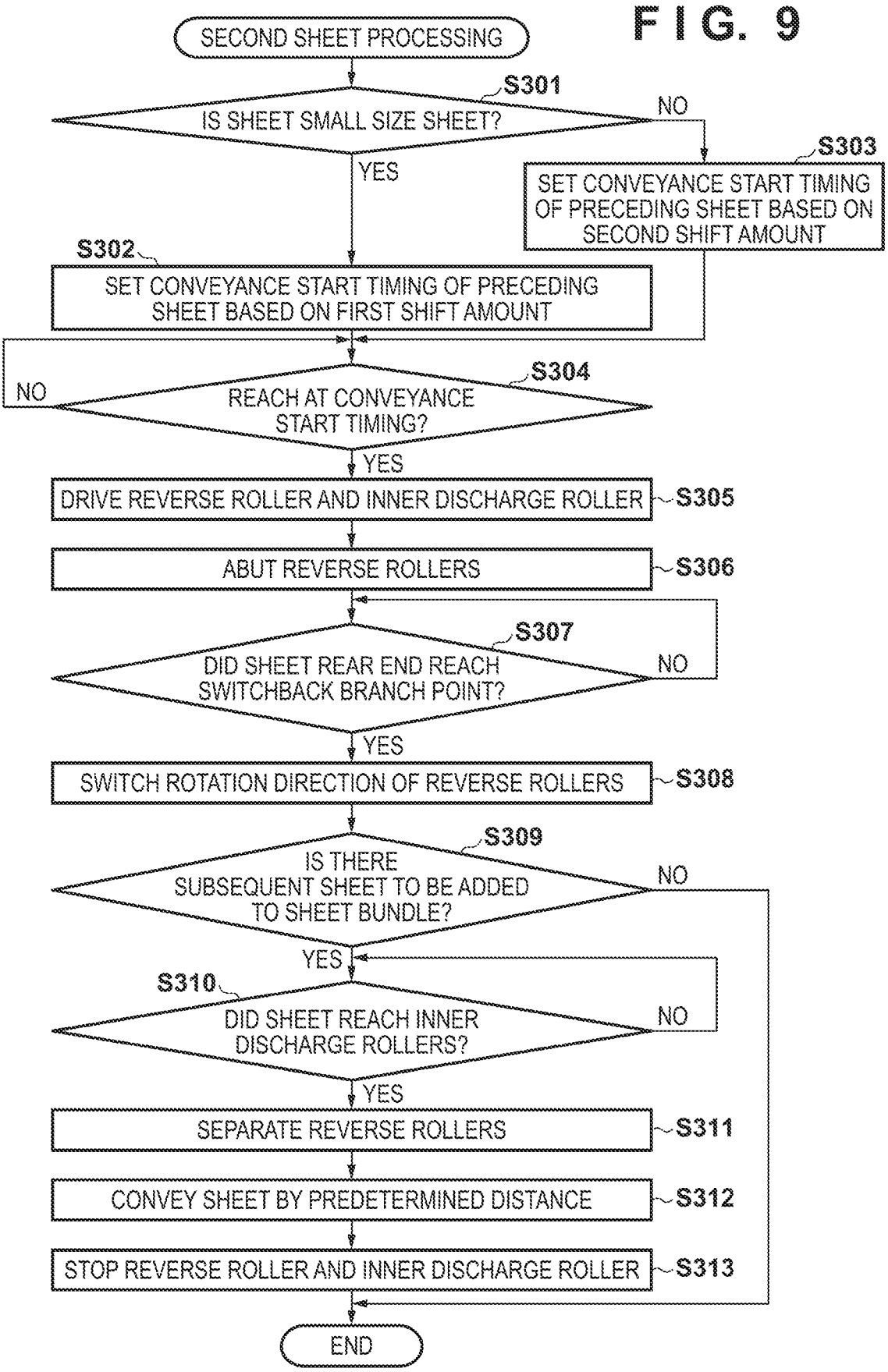
FIG. 9 is a flowchart depicting a procedure of second sheet processing (S104) (first embodiment)

With reference to FIGS. 7, 8, and 9, the sheet conveyance control performed by the conveyance control unit 410 (CPU 401) in the post-processing apparatus 4 of the present embodiment will be described. FIG. 7 is a flowchart depicting the processing procedure for conveyance control of a sheet. FIG. 8 is a flowchart depicting a procedure of first sheet processing in S103, and FIG. 9 is a flowchart depicting a procedure of second sheet processing in S104 in FIG. 7.

In the image forming system 1S, when execution of an image forming job including post-processing (sheet processing) by the post-processing apparatus 4 is started, the conveyance control unit 410 in the finisher control unit 400 performs the processing according to the procedure of FIG. 7 in accordance with an instruction from the printer control unit 100. The following processing is performed each time a sheet on which an image has been formed is conveyed one by one from the image forming apparatus 1.

First, the conveyance control unit 410 (CPU 401) waits until the inlet sensor 27 detects the rear end of the sheet (hereinafter referred to as a "target sheet"), which is a sheet discharged from the image forming apparatus 1 through the conveyance path 14, to be processed by the post-processing apparatus 4. In S101, when the inlet sensor 27 detects the rear end of the target sheet conveyed from the image forming apparatus 1, the conveyance control unit 410 advances the processing to S102.

In S102, the conveyance control unit 410 determines whether the target sheet whose rear end has been detected by the inlet sensor 27 is the first sheet of a sheet bundle (a sheet bundle to be bound by binding processing) as a processing unit in post-processing. When the target sheet is the first sheet of the sheet bundle, the conveyance control unit 410 advances the processing to S103, and performs the first sheet processing according to the procedure of FIG. 8. On the other hand, when the target sheet is not the first sheet of the sheet bundle (that is, the second or subsequent sheet), the conveyance control unit 410 advances the processing to S104 and performs the second sheet processing according to the procedure of FIG. 9. Upon completion of the processing in S103 or S104, the conveyance control unit 410 terminates the processing according to the procedure of FIG. 7.

By performing the processing in S103 and S104, the sheet bundle in the imbricated state is generated in the above-described buffer section (the inner discharge path 82 and the first discharge path 83). Subsequently, the conveyance control unit 410 conveys the sheet bundle in the imbricated state generated in the buffer section to the intermediate stacking portion through the inner discharge path 82, and performs the alignment processing and the post-processing (binding processing) on the conveyed sheet bundle in the intermediate stacking portion by the binding processing unit 4A. The sheet bundle on which the binding processing has been performed is discharged to the lower discharge tray 37 through the second discharge path 84.

<First Sheet Processing (S103)>

The first sheet processing (processing of the first sheet) in S103 is performed according to the procedure of FIG. 8. First, in S201, the conveyance control unit 410 (CPU 401) waits for the rear end of the target sheet detected by the inlet sensor 27 in S101 to reach the switchback branch point. As described above, the switchback branch point is the position at which the entry path 81 and the inner discharge path 82 branch from the first discharge path 83. When the rear end of the target sheet reaches the switchback branch point, the conveyance control unit 410 advances the processing to S202.

In S202, the conveyance control unit 410 switches (reverses) the rotation direction of the reverse rollers 24 to feed the target sheet whose rear end has reached the switchback branch point in the inner discharge path 82, and advances the processing to S203. In S203, the conveyance control unit 410 waits for (the distal end of) the target sheet that has been fed in the inner discharge path 82 to reach the inner discharge rollers 26, and when the target sheet reaches the inner discharge rollers 26, the processing proceeds to S204. In S204, the conveyance control unit 410 drives the second reverse motor M4 to separate the reverse rollers 24.

Subsequently, in S205, the conveyance control unit 410 drives the inner discharge motor M6 to convey the target sheet by the inner discharge rollers 26 by a predetermined distance (10 mm in the present embodiment). When the target sheet is conveyed by the predetermined distance, in S206, the conveyance control unit 410 stops driving the first reverse motor M3 and the inner discharge motor M6 to stop the reverse rollers 24 and the inner discharge rollers 26, and terminates the processing according to the procedures of FIGS. 8 and 7. As a result, the first sheet of the sheet bundle (the sheet bundle to be bound by the binding processing) as the processing unit in the post-processing stops in the inner discharge path 82 at a position (FIG. 3A) where the distal end of the sheet advances by the predetermined distance (10 mm) from the position of the inner discharge rollers 26.

Note that the determination of the position of the target sheet in S201 and S203 and the determination of the conveyance distance of the target sheet in S205 may be performed based on the elapsed time from the detection timing of the rear end of the target sheet by the inlet sensor 27. Alternatively, these determinations may be performed based on a count value of a drive pulse of each motor.

<Second Sheet Processing (S104)>

The second sheet processing in S104 (processing of the second and subsequent sheets) is performed according to the procedure of FIG. 9. First, in S301, the conveyance control unit 410 (CPU 401) determines whether the target sheet is a sheet having a predetermined threshold size or less (small size). The conveyance control unit 410 acquires the sheet size set via the operation display unit 103 as the size of the target sheet by the information acquisition unit 412 and performs determination based on the acquired size. Alternatively, the information acquisition unit 412 may acquire the size of the target sheet from the setting of the image forming job.

As described above, the conveyance control unit 410 determines whether the size of the target sheet is the threshold size or less based on the sheet size set by the user. For instance, as the threshold sizes, the length of the sheet in the conveyance direction is set to 210 mm, and the length (width) of the sheet in the width direction is set to 148 mm in advance. When it is determined that the target sheet is a small-size sheet, the conveyance control unit 410 advances the processing to S302. When it is determined that the target sheet does not have a small size, the conveyance control unit 410 advances the processing to S303.

The information acquisition unit 412 may acquire the size of the target sheet by measuring at least any of the length and the width of the sheet conveyed on the conveyance paths. In this case, a sensor that allows detecting the size of the sheet during conveyance is arranged upstream of the buffer section in the sheet conveyance direction. The information acquisition unit 412 measures at least any of the length and the width of the target sheet during conveyance on the conveyance paths using the sensor arranged in the conveyance path, and acquires the measurement result. The conveyance control unit 410 determines whether the size of the target sheet is the threshold size or less based on the measurement result by the sensor.

In S302 and S303, the conveyance control unit 410 sets the conveyance start timing of the preceding sheet waiting at the position (buffer section) illustrated in FIG. 3A on the inner discharge path 82 and the first discharge path 83. Here, the conveyance start timing of the preceding sheet is a timing at which the preceding sheet waiting in the buffer section starts to be conveyed in the direction of the upper discharge tray 25 with reference to the timing at which the rear end of the target sheet is detected by the inlet sensor 27. The preceding sheet stands by at the position (buffer section) illustrated in FIG. 3A on the inner discharge path 82 and the first discharge path 83.

In S302, the conveyance control unit 410 sets the conveyance start timing of the preceding sheet such that the shift amount of the position in the conveyance direction when the target sheet is overlapped with the preceding sheet becomes a first shift amount (for instance, 25 mm). On the other hand, in S303, the conveyance control unit 410 sets the conveyance start timing of the preceding sheet such that the shift amount of the position in the conveyance direction when the target sheet is overlapped with the preceding sheet becomes a second shift amount (for instance, 30 mm) larger than the first shift amount.

When the setting of S302 or S303 is completed, in S304, the conveyance control unit 410 stands by until the conveyance start timing of the preceding sheet is reached, and advances the processing to S305 when the conveyance start timing of the preceding sheet is reached. In S305, the conveyance control unit 410 starts rotational driving of the reverse rollers 24 and the inner discharge rollers 26 such that the preceding sheet and the target sheet conveyed to be overlapped on the preceding sheet are conveyed in the direction of the upper discharge tray 25.

Further, in S306, the conveyance control unit 410 brings the roller pair of the reverse rollers 24 into abutment with one another and advances the processing to S307.

In S307, similarly to S201, the conveyance control unit 410 waits for the rear end of the target sheet detected by the inlet sensor 27 in S101 to reach the switchback branch point. When the rear end of the target sheet reaches the switchback branch point (as illustrated in FIG. 3C), the conveyance control unit 410 advances the processing to S307. In S308, similarly to S202, the conveyance control unit 410 switches (reverses) the rotation directions of the reverse rollers 24 to feed the target sheet whose rear end has reached the switchback branch point in the inner discharge path 82, and advances the processing to S309.

In S309, the conveyance control unit 410 determines whether there is the subsequent sheet (whether the subsequent sheet remains) to be further added to the sheet bundle in the imbricated state generated in the buffer section. When there is no subsequent sheet, the conveyance control unit 410 terminates the processing according to the procedures of FIGS. 9 and 7. In this case, the sheet bundle in the imbricated state generated in the buffer section is fed in the binding processing unit 4A (intermediate stacking portion) through the inner discharge path 82. The binding processing unit 4A performs the longitudinal alignment on the sheet bundle conveyed from the buffer section, and further performs binding processing.

On the other hand, when there is the subsequent sheet, the conveyance control unit 410 advances the processing from S309 to S310. In S310, similarly to S203, the conveyance control unit 410 waits for (the distal end of) the target sheet that has been fed in the inner discharge path 82 to reach the inner discharge rollers 26, and when the target sheet reaches the inner discharge rollers 26, the processing proceeds to S311. In S311, similarly to S204, the conveyance control unit 410 separates the reverse rollers 24.

Subsequently, in S312, similarly to S205, the conveyance control unit 410 conveys the target sheet by the inner discharge rollers 26 by a predetermined distance (10 mm in the present embodiment). When the target sheet is conveyed by the predetermined distance, in S313, similarly to S206, the conveyance control unit 410 stops the reverse rollers 24 and the inner discharge rollers 26, and terminates the processing according to the procedures of FIGS. 9 and 7. As a result, the target sheet stops in the inner discharge path 82 at a position (FIG. 3A) where the distal end of the target sheet advances by the predetermined distance (10 mm) from the positions of the inner discharge rollers 26 with the target sheet overlapped with the preceding sheet in the imbricated state. In this way, the sheet bundle in which one or more sheets including the target sheet are overlapped with the first sheet in the imbricated state stops at a position illustrated in FIG. 3D. In this case, by performing the processing according to the procedures of FIGS. 7 and 9, the subsequent sheet is further added to the sheet bundle in the imbricated state generated in the buffer section.

Note that the determination of the position of the target sheet in S304, S307, and S310 and the determination of the conveyance distance of the target sheet in S312 may be performed based on the elapsed time from the detection timing as a reference of the rear end of the target sheet by the inlet sensor 27. Alternatively, these determinations may be performed based on a count value of a drive pulse of each motor.

As described above, the post-processing apparatus 4 of the present embodiment includes the stacking portion (intermediate stacking portion) on which sheets targeted for sheet processing are stacked, and the conveyance control unit 410. The conveyance control unit 410 generates, in the buffer section provided on the conveyance path for conveying the sheets to the stacking portion, the sheet bundle in which the positions of the sheets conveyed on the conveyance paths are shifted in sequence to the upstream side in the sheet conveyance direction and overlapped. The conveyance control unit 410 controls the conveyance of the sheets on the conveyance paths such that the sheet bundle is conveyed from the buffer section to the stacking portion. The alignment processing unit performs alignment processing for aligning the positions of the sheets in the sheet conveyance direction, on the sheet bundle stacked on the stacking portion. The binding processing unit 4A performs sheet processing (binding processing) on the sheet bundle on which the alignment processing has been performed. The conveyance control unit 410 controls the shift amounts of the positions of the sheets when the sheets are overlapped in the buffer section in sequence, according to the sizes of the sheets conveyed on the conveyance paths.

Thus, the post-processing apparatus 4 of the present embodiment controls the shift amount of the position of the sheet when the sheet bundle in the imbricated state is generated by overlapping the sheets in the buffer section in sequence, according to the sizes of the sheets to be processed. As a result, the total length of the sheet bundle in the imbricated state in the sheet conveyance direction can be shortened according to the size of the sheet. As a result, it is possible to shorten the time required to convey a sheet bundle formed of small-sized sheets to the binding processing unit 4A (post-processing unit) and is possible to shorten the time required for longitudinal alignment of the sheet bundle. Therefore, according to the present embodiment, it is possible to improve the productivity of the post-processing apparatus 4 (sheet processing apparatus) while maintaining the accuracy of the alignment processing of the sheet (ensuring the longitudinal alignment capability).

Second Embodiment

In the second embodiment, in the intermediate stacking portion of the post-processing apparatus 4, not only the longitudinal alignment but also transverse alignment (alignment processing for aligning the positions of sheets in the sheet width direction orthogonal to the sheet conveyance direction) is performed on the sheet bundle in the imbricated state conveyed from the buffer section and stacked. In addition, when the size of the sheet to be processed is small, shift processing for shifting the position of the sheet bundle in the sheet width direction is performed in the buffer section as necessary to prevent a decrease in the accuracy of transverse alignment. Further, based on whether the shift processing is performed, the shift amount of the sheet when the sheet bundle is generated is controlled. In the following, description will be given with a focus on differences from the first embodiment, and description of portions common to the first embodiment will be omitted.

<Shift Processing of Sheet Bundle>

With reference to FIGS. 2A, 2B and 3A to 3D, description will be given of shift processing of shifting the sheet bundle in the imbricated state in the sheet width direction orthogonal to the sheet conveyance direction using the reverse rollers 24. After the sheet bundle is fed in the binding processing unit 4A, the post-processing apparatus 4 of the present embodiment performs not only the longitudinal alignment but also transverse alignment on the sheet bundle by moving the transverse alignment jogger 58 illustrated in FIG. 2B in the sheet width direction. The transverse alignment is processing (alignment processing) for aligning the positions of a plurality of sheets in the sheet width direction.

In the binding processing unit 4A of the present embodiment, the transverse alignment jogger 58 and the transverse alignment reference plate 52 configure an alignment processing unit (alignment unit) that performs alignment processing for aligning the positions of the sheets in the sheet width direction orthogonal to the sheet conveyance direction on the sheet bundle stacked on the stacking portion. The transverse alignment jogger 58 is an example of an alignment member provided along the sheet conveyance direction, and the transverse alignment reference plate 52 is an example of a second reference plate provided along the sheet conveyance direction. The alignment processing unit configured by the transverse alignment jogger 58 and the transverse alignment reference plate 52 performs the alignment processing (transverse alignment) in the sheet width direction on the sheet bundle stacked on the intermediate stacking portion. Specifically, the alignment processing unit performs the transverse alignment by moving the sheet bundle in the sheet width direction by the transverse alignment jogger 58 (alignment member) such that the end portion along the sheet conveyance direction of the sheet bundle stacked on the intermediate stacking portion contacts the transverse alignment reference plate 52 and is aligned.

In the transverse alignment in the binding processing unit 4A, as the width of the sheet included in the sheet bundle becomes narrower, the distances between the end portion of the sheet in the sheet width direction and the transverse alignment reference plate 52 becomes longer, and the moving amount of the transverse alignment jogger 58 when the transverse alignment is performed becomes larger. Further, the moving amount of the sheet itself in the sheet width direction when the transverse alignment is performed also becomes large. When the moving amount of the sheet in the sheet width direction becomes large, a force for turning the sheet bundle to be transversely aligned is generated due to friction between the sheet bundle to be aligned and the intermediate lower guide 32 or the sheets previously stacked on the intermediate lower guide 32. This leads to a decrease in transverse alignment capability of the binding processing unit 4A (a decrease in accuracy of the alignment processing).

For this reason, when post-processing (binding processing) is performed on sheets having narrow widths, the post-processing apparatus 4 of the present embodiment performs shift processing of shifting the sheet bundle at a position illustrated in FIG. 3C in the buffer section in a direction orthogonal to the conveyance direction after generating the sheet bundle in the imbricated state. To be more specific, the conveyance control unit 410 performs the shift processing on the sheet bundle when the size of the sheet to be processed is the threshold size or less (for instance, the width of the sheet is 148 mm or less). This shift processing is performed by driving the third reverse motor M5 to move the roller pair of reverse rollers 24. As described above, the reverse rollers 24 of the present embodiment are an example of shift units provided in the buffer section and shifting the position of the sheet bundle generated in the buffer section in the sheet width direction.

When the sheet bundle is conveyed to the binding processing unit 4A, the post-processing apparatus 4 (conveyance control unit 410) performs the shift processing of the sheet bundle in the direction in which the distance between the end portion of the sheet and the transverse alignment reference plate 52 in the sheet width direction shortens. That is, the post-processing apparatus 4 (conveyance control unit 410) performs the shift processing of shifting the position of the sheet bundle in the sheet width direction by the reverse rollers 24 such that the moving amount of the sheet in transverse alignment (alignment processing in the sheet width direction by the alignment processing unit) is reduced. The sheet bundle on which the shift processing has been performed is conveyed from the buffer section to the binding processing unit 4A through the inner discharge path 82.

As described above, by shifting the position of the sheet bundle in the sheet width direction by the shift processing using the reverse rollers 24, the distance between the end portion of the sheet and the transverse alignment reference plate 52 is shortened. As a result, even when transverse alignment is performed on a sheet bundle including sheets having narrow widths, the moving amount of the sheets by the transverse alignment jogger 58 can be suppressed, and the decrease in the transverse alignment capability of the binding processing unit 4A can be suppressed.

On the other hand, as described above, when the shift processing is performed using the reverse rollers 24 before the sheet bundle is fed in the binding processing unit 4A, it is necessary to avoid collision between the sheet bundle on which the shift processing is performed and the subsequent sheet conveyed from the image forming apparatus 1. For this reason, it is necessary to increase the distance (sheet interval) between the sheets conveyed from the image forming apparatus 1, and this possibly reduces the productivity of the image forming system 1S.

In the post-processing apparatus 4 of the present embodiment, as described above, even when the sheet interval is increased along with the execution of the shift processing, the shift amount of the sheet when the sheet bundle in the imbricated state is generated in the buffer section is controlled to prevent the decrease in the productivity of the post-processing apparatus 4. Specifically, the conveyance control unit 410 sets the shift amount in the case of performing the shift processing on the sheet bundle to be smaller than that in the case of not performing the shift processing on the sheet bundle. For instance, the shift amount in the case where the shift processing is not performed on the sheet bundle is set to 30 mm, and the shift amount in the case where the shift processing is performed on the sheet bundle is set to 25 mm, which is shorter than that by 5 mm. This setting allows shortening the total length of the sheet bundle in the imbricated state conveyed from the buffer section to the intermediate stacking portion. Therefore, even when the sheet interval is increased along with the execution of the shift processing, the decrease in the productivity of the post-processing apparatus 4 can be reduced.

Further, in the post-processing apparatus 4 of the present embodiment, the shift processing of the sheet is performed when the size of the sheet to be processed is the threshold size or less. Therefore, in a case where the size of the sheet to be processed is the threshold size or less, control for reducing the shift amount of the sheet when the sheet bundle is generated as described above is performed together with the shift processing. Therefore, when the shift processing is performed, it is possible to reduce the decrease in the productivity of the post-processing apparatus 4 while maintaining the accuracy of the alignment processing in the sheet conveyance direction (ensuring the longitudinal alignment capability) similarly to the first embodiment.

<Processing Procedure>

With reference to FIGS. 7, 8, 10A, 10B, and 11, the sheet conveyance control performed by the conveyance control unit 410 (CPU 401) in the post-processing apparatus 4 of the present embodiment will be described. The processing of FIGS. 7 and 8 is similar to that of the first embodiment in the present embodiment. In S104 of FIG. 7, the conveyance control unit 410 performs processing according to the procedure of FIGS. 10A and 10B.

<Second Sheet Processing (S104)>

Figure 10A:
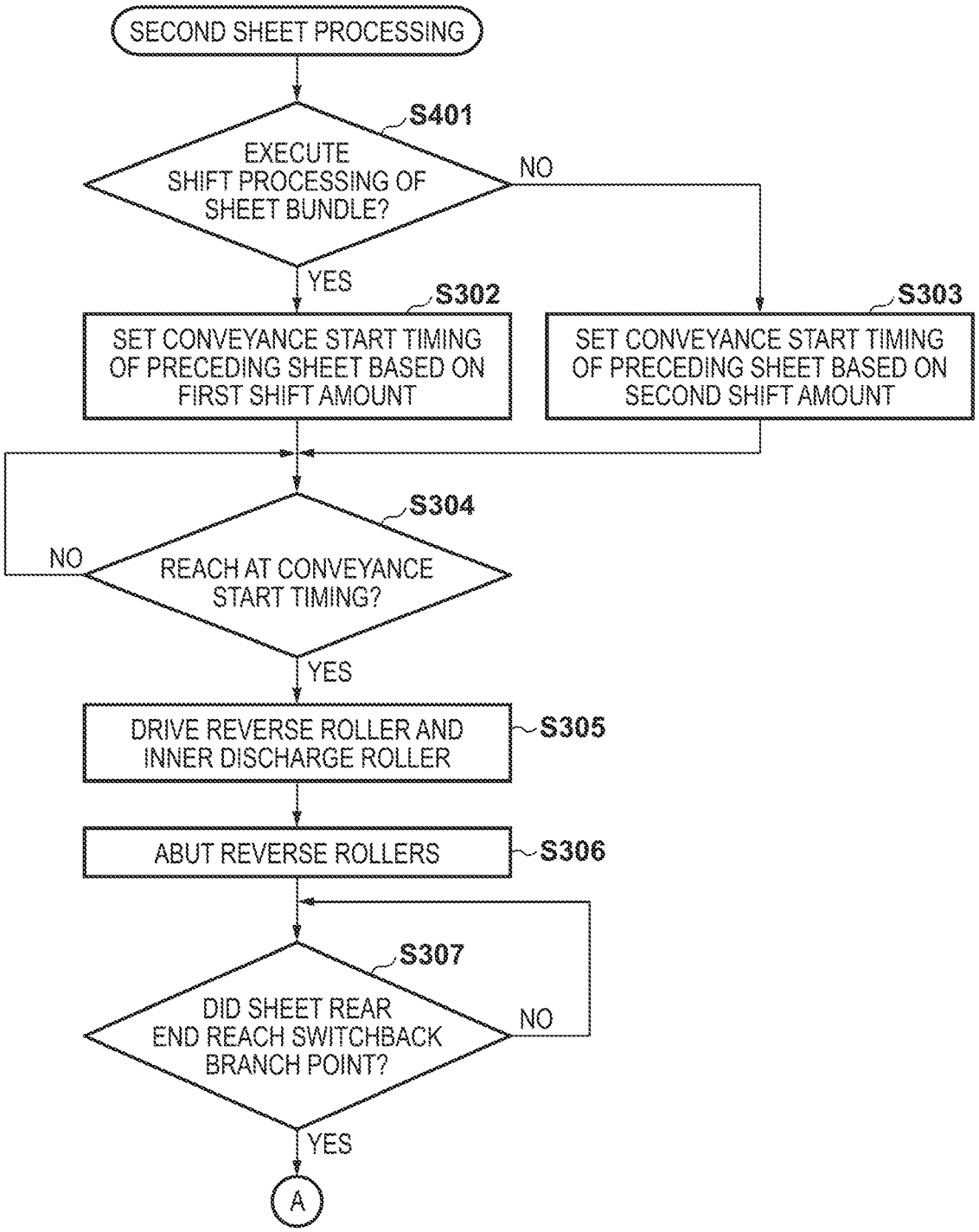
FIGS. 10A and 10B are flowcharts depicting a procedure of second sheet processing (S104) (second embodiment)
Figure 10B:
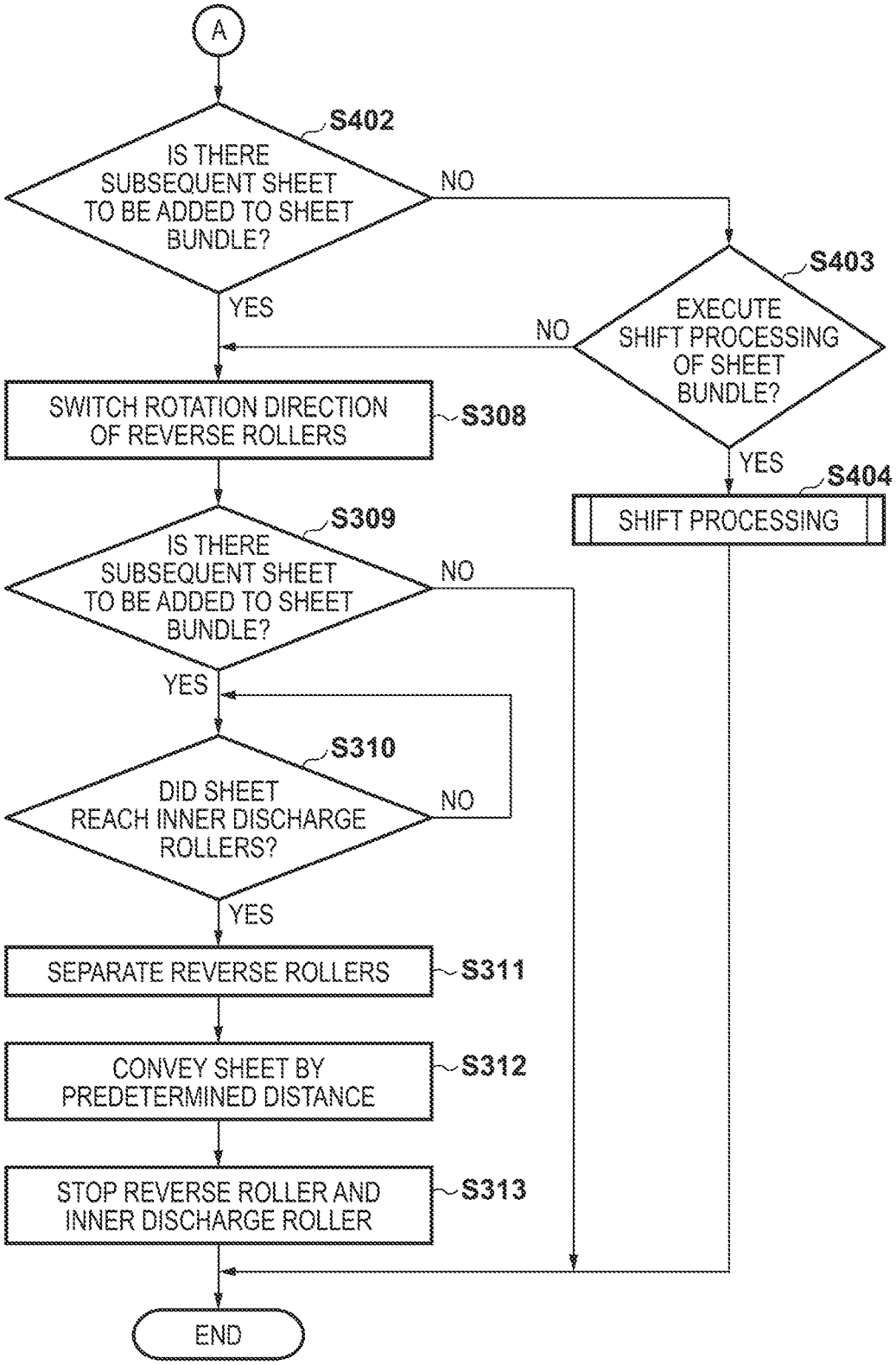

The second sheet processing in S104 (processing of the second and subsequent sheets) is performed according to the procedure of FIGS. 10A and 10B. First, in S401, the conveyance control unit 410 (CPU 401) determines whether to perform the above-described shift processing of the sheet bundle in the buffer section. In the present embodiment, when the size of the target sheet is the predetermined size or less, the conveyance control unit 410 determines that the shift processing is performed on the sheet bundle and advances the processing to S302. On the other hand, when the conveyance control unit 410 determines that the shift processing is not performed on the sheet bundle, the conveyance control unit 410 advances the processing to S303.

In S302 and S303, the conveyance control unit 410 sets the shift amount of the position in the conveyance direction when the target sheet is overlapped with the preceding sheet, similarly to the first embodiment. In S302, the first shift amount (for instance, 25 mm) is used, and in S303, the second shift amount (for instance, 30 mm) larger than the first shift amount is used.

The processing from S304 to S307 is similar to that of the first embodiment. In S307, when the rear end of the target sheet detected by the inlet sensor 27 in S101 reaches the switchback branch point, the conveyance control unit 410 advances the processing to S402.

In S402, the conveyance control unit 410 determines whether there is the subsequent sheet (whether the subsequent sheet remains) to be further added to the sheet bundle in the imbricated state generated in the buffer section. When there is the subsequent sheet, the conveyance control unit 410 advances the processing to S308. When there is no subsequent sheet, the conveyance control unit 410 advances the processing to S403. In S403, similarly to S401, the conveyance control unit 410 determines whether to perform the above-described shift processing of the sheet bundle in the buffer section. When the shift processing is not performed, the conveyance control unit 410 advances the processing to S308. When the shift processing is performed, the conveyance control unit 410 advances the processing to S404. In S404, the conveyance control unit 410 performs the shift processing of the sheet bundle in the buffer section according to the procedure of FIG. 11.

On the other hand, when the processing proceeds to S308, the conveyance control unit 410 performs the processing from S308 to S313 similar to the first embodiment.

<Shift Processing (S410)>

Figure 11:
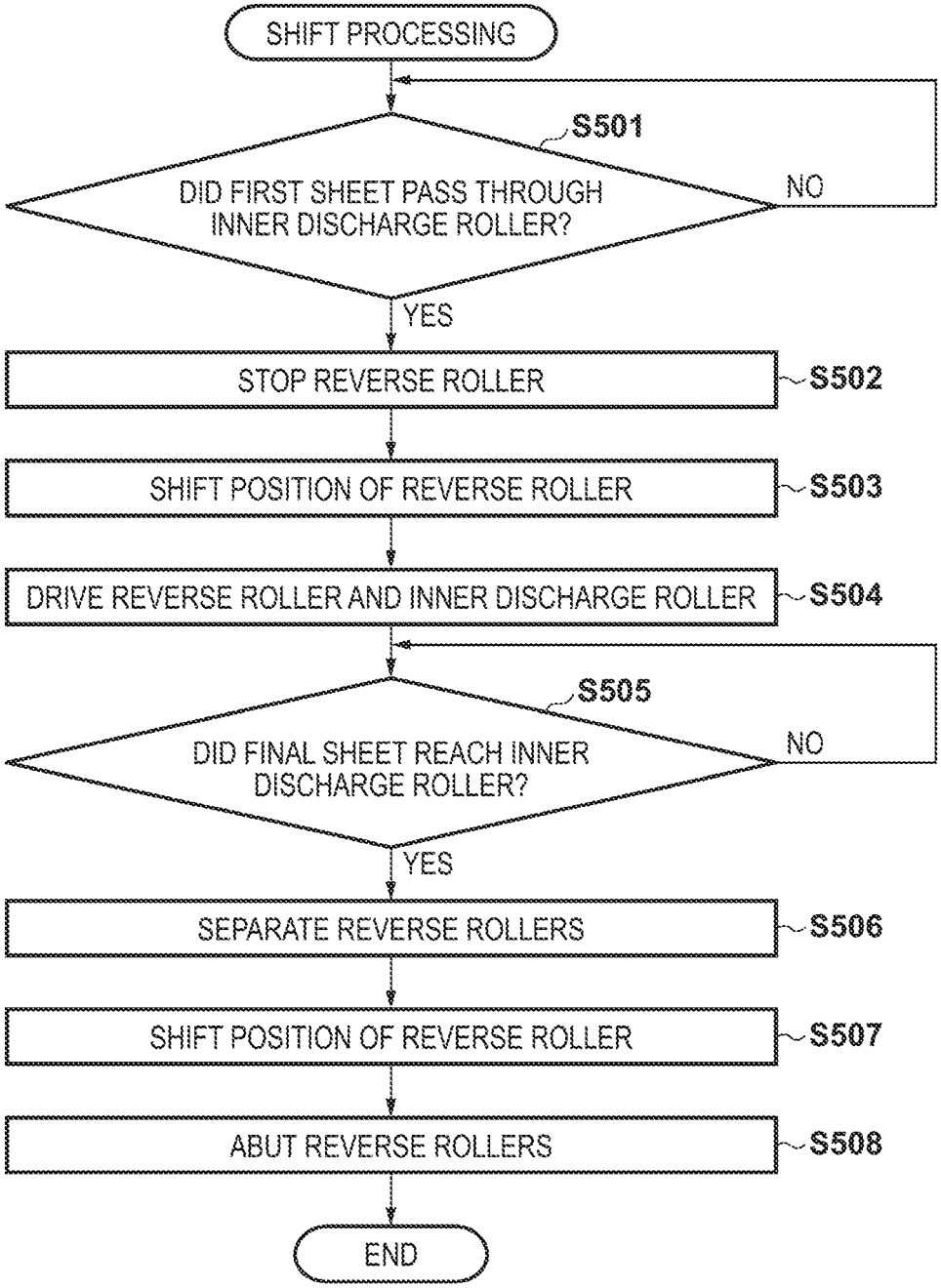
FIG. 11 is a flowchart depicting a procedure of shift processing (S404) of a sheet bundle (second embodiment).

FIG. 11 is a flowchart depicting the procedure of shift processing of the sheet bundle performed using the reverse rollers 24 in S410. When the shift processing starts, the conveyance control unit 410 waits for the first sheet (the lowermost sheet) of the sheet bundle in the imbricated state generated in the buffer section to pass through the position of the inner discharge rollers 26 (between the roller pair) in S501. Note that the sheet bundle is during conveyance in the direction of the upper discharge tray 25 by the processing of S305 and S306. When the rear end of the first sheet of the sheet bundle during conveyance passes through the positions of the inner discharge rollers 26, the conveyance control unit 410 advances the processing to S502.

In S502, the conveyance control unit 410 stops the reverse rollers 24. At this time, since the entire sheet bundle has passed through the inner discharge rollers 26, the sheet bundle stops in a state of being nipped only by the roller pair of the reverse rollers 24.

Next, in S503, the conveyance control unit 410 drives the third reverse motor M5 for a predetermined time to shift the positions of the reverse rollers 24 in the sheet width direction, thereby shifting the position of the sheet bundle. At this time, the conveyance control unit 410 performs the shift processing of the sheet bundle in the direction (for example, the direction on the front side in FIG. 1) in which the distance between the end portion of the sheet and the transverse alignment reference plate 52 in the sheet width direction shortens. As described above, by shifting the positions of the reverse rollers 24, the position of the sheet bundle nipped by the reverse rollers 24 is shifted in the sheet width direction. In accordance with the shift amount (for instance, 20 mm) of the reverse rollers 24 (sheet bundle), the moving distance of the sheet bundle in the sheet width direction when the transverse alignment is performed in the binding processing unit 4A shortens.

When the shift of the reverse rollers 24 is completed, the conveyance control unit 410 advances the processing to S504. In S504, the conveyance control unit 410 starts rotational driving of the reverse rollers 24 and the inner discharge rollers 26 such that the sheet bundle is conveyed in the direction of the binding processing unit 4A, and advances the processing to S505. In S505, the conveyance control unit 410 waits for the last sheet (uppermost sheet) of the sheet bundle during conveyance to reach the inner discharge rollers 26, and when the last sheet reaches the inner discharge rollers 26, the conveyance control unit 410 advances the processing to S506.

In S506, the conveyance control unit 410 separates the reverse rollers 24. At this time, the last sheet of the sheet bundle is nipped and conveyed by the roller pair of inner discharge rollers 26. Therefore, the conveyance of the sheet bundle is continued even when the reverse rollers 24 are separated.

Next, in S507, to return the positions of the reverse rollers 24 shifted in S503 to the original positions, the conveyance control unit 410 drives the third reversing motor M5 for a predetermined time to shift the positions of the reverse rollers 24 in the sheet width direction. When the shift of the reverse rollers 24 is completed, the conveyance control unit 410 advances the processing to S508. In S508, the conveyance control unit 410 brings the reverse rollers 24 into abutment with one another in preparation for conveyance of the subsequent sheet from the image forming apparatus 1.

Note that the determination of the positions of the sheets in S501 and S505 may be performed based on the elapsed time from the detection timing as a reference of the rear end of the target sheet by the inlet sensor 27. Alternatively, these determinations may be performed based on a count value of a drive pulse of each motor.

As described above, when the shift processing of the sheet bundle is performed in the buffer section according to the procedure of FIG. 11, it is necessary to avoid collision between the sheet bundle on which the shift processing is performed and the subsequent sheet conveyed from the image forming apparatus 1. For this reason, it is necessary to increase the distance (sheet interval) between the sheets conveyed from the image forming apparatus 1, and this possibly reduces the productivity of the image forming system 1S.

In the present embodiment, by performing the processing according to the procedure of FIGS. 10A and 10B, when the shift processing of the sheet bundle is performed, the total length in the conveyance direction of the sheet bundle in the imbricated state generated in the buffer section is shortened. Therefore, even when the sheet interval is increased along with the execution of the shift processing, the decrease in the productivity of the post-processing apparatus 4 can be reduced. Further, the shift processing of the sheet is performed in a case where the size of the sheet to be processed is the threshold size or less, and in accordance with it, control for reducing the shift amount of the sheet when generating the sheet bundle is performed. Therefore, when the shift processing is performed, it is possible to reduce a decrease in productivity of the post-processing apparatus 4 while maintaining the accuracy of the alignment processing in the sheet conveyance direction (ensuring the longitudinal alignment capability).

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-042779, filed Mar. 17, 2022, which is hereby incorporated by reference herein in its entirety.

What is claimed is:

1. A sheet processing apparatus, comprising:

a stacking portion on which sheets targeted for sheet processing are stacked;

a control unit configured to generate, in a buffer section provided in a conveyance path for conveying sheets to the stacking portion, a sheet bundle in which positions of sheets conveyed in the conveyance path are shifted in sequence to an upstream side with respect to a conveyance direction and overlapped, and to control conveyance of the sheets in the conveyance path such that the sheet bundle is conveyed from the buffer section to the stacking portion;

an alignment unit configured to perform alignment processing that aligns positions of the sheets in the conveyance direction on the sheet bundle stacked on the stacking portion; and a processing unit configured to perform sheet processing on the sheet bundle on which the alignment processing has been performed, wherein the control unit is configured to control shift amounts of the positions of the sheets when the sheets are overlapped in the buffer section in sequence, according to sizes of the sheets conveyed in the conveyance path, and the control unit is configured to decrease the shift amount with a decrease in size of the sheet conveyed in the conveyance path.

2. The sheet processing apparatus according to claim 1, wherein the control unit is configured to set the shift amount in a case where the size of the sheet conveyed in the conveyance path is a threshold size or less, to be less than the shift amount in a case where the size is not the threshold size or less.

3. The sheet processing apparatus according to claim 2, wherein the control unit is configured to determine whether or not the size of the sheet conveyed in the conveyance path is the threshold size or less based on at least any of a length in the conveyance direction of the sheet conveyed in the conveyance path and a width of the sheet in a width direction orthogonal to the conveyance direction.

4. The sheet processing apparatus according to claim 2, wherein the control unit is configured to determine whether or not the size of the sheet conveyed in the conveyance path is the threshold size or less based on a sheet size set by a user.

5. The sheet processing apparatus according to claim 2, further comprising:

a measurement unit provided upstream of the buffer section with respect to the conveyance direction, the measurement unit being configured to measure at least any of a length in the conveyance direction of the sheet conveyed in the conveyance path and a width of the sheet in a width direction orthogonal to the conveyance direction, wherein the control unit is configured to determine whether or not the size of the sheet conveyed in the conveyance path is the threshold size or less based on a measurement result by the measurement unit.

6. The sheet processing apparatus according to claim 1, wherein the alignment unit includes an alignment roller and a reference plate, the alignment roller is configured to be rotationally driven to move the sheet in the conveyance direction, the reference plate is provided along a width direction orthogonal to the conveyance direction, and the alignment unit is configured to perform alignment processing in the conveyance direction on the sheet bundle by moving the sheets of the sheet bundle stacked on the stacking portion to downstream in the conveyance direction one by one in sequence from a bottom by the alignment roller and bringing end portions of the respective sheets in abutment against the first reference plate.

7. The sheet processing apparatus according to claim 1, wherein the alignment unit is configured to further perform alignment processing, which aligns the positions of the sheets in a width direction orthogonal to the conveyance direction, on the sheet bundle stacked on the stacking portion;

the sheet processing apparatus further includes a shift unit provided in the buffer section, and the shift unit is configured to shift a position of the sheet bundle generated in the buffer section in the width direction; and the control unit is configured to perform shift processing that shifts the position of the sheet bundle in the width direction by the shift unit such that moving amounts of the sheets in the alignment processing in the width direction by the alignment unit are reduced.

8. The sheet processing apparatus according to claim 7, wherein the alignment unit includes an alignment member and a reference plate provided along the conveyance direction, and the alignment unit is configured to perform the alignment processing in the width direction on the sheet bundle by moving the sheet bundle in the width direction by the alignment member such that an end portion along the conveyance direction of the sheet bundle stacked on the stacking portion contacts the second reference plate and is aligned.

9. The sheet processing apparatus according to claim 7, wherein the control unit is configured perform the shift processing on the sheet bundle in a case where the size of the sheet conveyed on the conveyance path is a threshold size or less.

10. The sheet processing apparatus according to claim 9, wherein the control unit is configured to set the shift amount in a case where the shift processing is performed on the sheet bundle to be less than the shift amount in a case where the shift processing is not performed on the sheet bundle.

11. The sheet processing apparatus according to claim 1, wherein the processing unit is configured to perform, as the sheet processing, binding processing that binds the sheet bundle stacked on the stacking portion.

12. An image forming system, comprising:

an image forming apparatus configured to form an image on a sheet; and a sheet processing apparatus coupled to a downstream side of the image forming apparatus in a conveyance direction of a sheet, and configured to perform sheet processing on the sheet conveyed from the image forming apparatus through a conveyance path, wherein the sheet processing apparatus comprises:

a stacking portion on which sheets targeted for the sheet processing are stacked;

a control unit configured to generate, in a buffer section provided in the conveyance path for conveying sheets to the stacking portion, a sheet bundle in which positions of sheets conveyed in the conveyance path are shifted in sequence to an upstream side with respect to the conveyance direction and overlapped, and to control conveyance of the sheets in the conveyance path such that the sheet bundle is conveyed from the buffer section to the stacking portion;

an alignment unit configured to perform alignment processing that aligns positions of the sheets in the conveyance direction on the sheet bundle stacked on the stacking portion; and a processing unit configured to perform sheet processing on the sheet bundle on which the alignment processing has been performed, wherein the control unit is configured to control shift amounts of the positions of the sheets when the sheets are overlapped in the buffer section in sequence according to sizes of the sheets conveyed in the conveyance path, and the control unit is configured to decrease the shift amount with a decrease in size of the sheet conveyed in the conveyance path.

* * * * *